US012025407B2

(12) United States Patent
Itshaky

(10) Patent No.: US 12,025,407 B2
(45) Date of Patent: Jul. 2, 2024

(54) ADJUSTABLE OFFSET MOUNT (AOM)

(71) Applicant: Boaz Itshaky, Bethany, CT (US)

(72) Inventor: Boaz Itshaky, Bethany, CT (US)

( * ) Notice: Subject to any disclaimer, the term of this patent is extended or adjusted under 35 U.S.C. 154(b) by 0 days.

(21) Appl. No.: 17/955,542

(22) Filed: Sep. 29, 2022

(65) Prior Publication Data

US 2023/0096361 A1 Mar. 30, 2023

Related U.S. Application Data

(60) Provisional application No. 63/250,428, filed on Sep. 30, 2021.

(51) Int. Cl.
*F41G 11/00* (2006.01)

(52) U.S. Cl.
CPC ..... *F41G 11/003* (2013.01)

(58) Field of Classification Search
CPC ..... F41G 11/003
See application file for complete search history.

(56) References Cited

U.S. PATENT DOCUMENTS 1,083,288 A 1/1914 Lowe
2,527,289 A * 10/1950 Allen ..... F41G 11/008 42/128
2,529,801 A * 11/1950 Fisk ..... F41G 11/008 108/45
2,559,971 A 7/1951 Kirby
2,571,935 A * 10/1951 Pachmayr ..... F41G 11/008 16/265
2,629,175 A * 2/1953 Merritt ..... F41G 11/008 42/128
2,773,310 A * 12/1956 Bircher ..... F41G 11/008 42/136
3,208,146 A 9/1965 Nelson
3,226,868 A * 1/1966 Mahoney ..... F41G 11/008 42/128
3,559,940 A * 2/1971 Kruzell ..... F41G 11/001 248/223.41
4,961,265 A 10/1990 Roberts
(Continued)

OTHER PUBLICATIONS

Rukh, Valhalla Tactical, first accessed Jul. 5, 2022, retrieved Dec. 5, 2022, https://www.valhallatactical.com/rukh-adjustable-offset-mount/.
(Continued)

*Primary Examiner* — Michelle Clement
(74) *Attorney, Agent, or Firm* — Law Office of John B. Hudak, PLLC; John Brian Hudak

(57) ABSTRACT

The adjustable offset mount (AOM) attaches to a firearm. The AOM is a mount for a firearm accessory, like a red dot sight. The AOM can hold the accessory: at an offset angle; an offset distance from the vertical plane of the center of the firearm barrel; and a distance from the horizontal plane of the center of the firearm barrel. The accessory can be adjusted from a first position to a second position where the first position and the second position have the same offset angle but the distance from the barrel is different. An embodiment of the AOM has: a base structure, which attaches to the firearm; an extension arm structure, where the accessory attaches; and a cinch pivot structure, which can be loosened and retightened to change the position of the extension arm structure.

6 Claims, 36 Drawing Sheets

(56) References Cited

U.S. PATENT DOCUMENTS

| | | | | |
|---|---|---|---|---|
| 6,591,538 | B2 | 7/2003 | Holler | |
| 6,991,384 | B1 | 1/2006 | Davis | |
| 7,367,152 | B2 | 5/2008 | Samson | |
| 7,908,782 | B1 * | 3/2011 | LaRue | F41G 11/008 42/124 |
| 8,132,355 | B1 | 3/2012 | Kincaid | |
| 8,438,773 | B2 * | 5/2013 | Carlson | F41G 11/008 42/90 |
| 8,499,485 | B2 * | 8/2013 | Deros | F41G 11/003 42/127 |
| 8,510,983 | B2 * | 8/2013 | Larue | F41G 11/003 42/124 |
| 8,793,921 | B1 * | 8/2014 | Tonello | F41G 11/008 42/125 |
| D718,833 | S * | 12/2014 | Huang | D22/108 |
| RE45,724 | E | 10/2015 | Dueck | |
| 9,217,621 | B2 * | 12/2015 | He | F41G 1/387 |
| 9,417,034 | B1 * | 8/2016 | Swan | F41G 11/007 |
| 9,470,470 | B2 | 10/2016 | Pisani | |
| 10,006,742 | B1 | 6/2018 | Campbell | |
| 10,030,935 | B1 * | 7/2018 | Ding | F41G 1/17 |
| 10,036,611 | B1 * | 7/2018 | Bozek | F41G 1/28 |
| 10,627,191 | B1 * | 4/2020 | Fischer | F41G 11/008 |
| 10,634,456 | B1 * | 4/2020 | Fischer | F41G 11/003 |
| 10,907,933 | B1 | 2/2021 | Hamm | |
| 11,193,734 | B2 * | 12/2021 | Xiong | F41G 1/387 |
| 11,365,954 | B2 | 6/2022 | Gerber | |
| 11,435,163 | B2 * | 9/2022 | Roberson | F41G 11/003 |
| 11,561,068 | B1 * | 1/2023 | Carter | F41G 11/008 |
| 11,592,266 | B2 * | 2/2023 | Mikroulis | F41G 1/473 |
| 11,692,795 | B2 * | 7/2023 | Connolly | F41G 11/004 42/90 |
| 2008/0107414 | A1 | 5/2008 | Showalter | |
| 2008/0209789 | A1 * | 9/2008 | Oz | F41G 11/003 42/90 |
| 2011/0310476 | A1 * | 12/2011 | Russ | G02B 23/18 359/407 |
| 2012/0106170 | A1 | 5/2012 | Matthews | |
| 2012/0167437 | A1 | 7/2012 | Holmberg | |
| 2013/0256484 | A1 | 10/2013 | Kessler | |
| 2014/0211020 | A1 | 7/2014 | Johns, Jr. | |
| 2014/0305022 | A1 * | 10/2014 | Chung | F41G 1/387 42/113 |
| 2014/0317987 | A1 | 10/2014 | Kuehl | |
| 2015/0052796 | A1 | 2/2015 | Baker | |
| 2018/0180386 | A1 | 6/2018 | Keller | |
| 2019/0368840 | A1 | 12/2019 | Banes | |
| 2020/0025522 | A1 * | 1/2020 | Zimmer | F41G 11/007 |
| 2021/0223000 | A1 * | 7/2021 | Donahue | F41G 1/14 |
| 2021/0348887 | A1 * | 11/2021 | Connolly | F41G 11/008 |
| 2022/0128337 | A1 | 4/2022 | Campbell | |
| 2023/0114998 | A1 * | 4/2023 | Carter | F41G 11/008 42/124 |

OTHER PUBLICATIONS

Feyachi M37 1.5X-5X Red Dot Magnifier With RS-30 Reflex Sight Combo Kit, Multiple Reticle System Red Dot Sight & Magnifier Built-In Flip Mount Combo; Feyachi; retrieved Sep. 12, 2022; https://www.feyachistore.com/ru/products/feyachi-m37-1-5x-5x-red-dot-magnifier-with-rs-30-reflex-sight-combo-kit-multiple-reticle-system-red-dot-sight-magnifier-built-in-flip-mount-combo.

* cited by examiner

ADJUSTABLE OFFSET MOUNT (AOM)

This application claims the benefit of U.S. Provisional Patent Application No. 63/250,428, entitled, "ADJUSTABLE OFFSET MOUNT (AOM)," filed on Sep. 30, 2021, the content of which is hereby incorporated by reference herein in its entirety.

BACKGROUND OF THE INVENTION

The background of the invention is described in the following headings of a description, the field of the invention, and the description of the prior art.

DESCRIPTION

The invention relates to an adjustable offset mount (AOM) for an accessory on a firearm.

An embodiment of the AOM removably attaches to the main accessory mount rail of the firearm. An embodiment of a main accessory mount rail of a firearm can be a Picatinny rail. An accessory is then removably attached to the AOM. Examples of accessories which can be removably attached to the AOM are a red dot sight, laser sight, white light, iron sights, or any other device that may needed to be mounted on a firearm.

An embodiment of the AOM includes the main elements of a base structure, a cinch pivot structure, and an extension arm structure. The base structure removably attaches to the main accessory mount rail of the firearm. The cinch pivot structure attaches the base structure to the extension arm structure. The extension arm structure includes an extension arm and an accessory mounting plate. The cinch pivot structure attaches the base structure to the extension arm. The accessory mounting plate attaches to the extension arm. An accessory, such as a sight, can be attached, or also called mounted, to the accessory mounting plate. The cinch pivot structure keeps the extension arm structure in the desired position when the cinch pivot structure is tightened, but the cinch pivot structure can be loosened to adjust the position of the extension arm structure, and then the cinch pivot structure can be re-tightened to keep the extension arm structure in the new desired position.

The extension arm can rotate in a co-axial plane from the bore of the firearm so the accessory can be adjusted to different offset angles. The extension arm can move inward and outward from the base so the accessory can be adjusted to different distances from the bore of the firearm.

FIELD OF THE INVENTION

Commonly a sight is attached to the top of a firearm. The sight is used to aim the firearm. For a rifle, the user of the firearm holds the firearm up to their eye, generally looking down the barrel of the firearm to aim. A sight is used to aim the firearm more accurately. Commonly on the top of a firearm, running down the length of the center of the barrel, or the longitudinal axis of the firearm, there is a main accessory mount rail. The main accessory mount rail can be a Picatinny rail. Commonly, a sight is attached to the main accessory mount rail. For instance, the sight can be an optical scope.

A sight attached to the main accessory mount rail is usually inline with the longitudinal axis of the firearm and the center of the sight is in the vertical plane of the firearm barrel.

A sight attached to the main accessory mount rail that is inline with the longitudinal axis of the firearm and the center of the sight is in the vertical plane of the firearm can be called the primary accessory, the primary sight, or the primary optic.

If there is another accessory, other than the primary accessory, which is also attached to the firearm, that other accessory can be called a secondary accessory, a secondary sight, or a secondary optic. The secondary sight can be in an offset position, meaning the sight is inline with the longitudinal axis of the firearm, but the center of the sight is not in the vertical plane of the firearm. The secondary sight faces front to back in the direction of the barrel of the firearm, which is another way of describing the sight is inline with the longitudinal axis of the firearm. But the secondary sight is generally, not on top and in the middle of the firearm, which is another way of describing the center of the sight is not in the vertical plane of the firearm. The quality of being in an offset position is generally describing the sight not over the top of the firearm.

Sights can also be described by how much they are rotated from their natural up and down position of use. For example, with an iron sight there can be a V element in the back of the firearm and an up and down short bar at the front of the firearm. The iron sight allows the user to align the up and down short bar with the V, and the up and down short bar is over the target to have the barrel of the gun aimed at the target. Usually, the iron sight is up and down in the vertical plane of the firearm. But the iron sight can be rotated to not be up and down with the vertical plane of the firearm. The up and down position in the vertical plane of the firearm can be considered zero degrees, and if the sight is rotated, then the angle from zero will be the degrees of rotation, or the offset angle. An optic can be on a mount which is offset, and can rotate to change the degrees of rotation, or offset angle.

Another adjustment which can occur is the distance an optic is from the horizontal plane of the firearm. This distance can also be adjusted if the optic is not offset, offset, rotated, or a combination of orientations.

Two optics can be attached to a firearm. The primary optic can be used for generally long distance shooting and the secondary optic can be used for short range shooting. A user may want to switch quickly from using the primary optic to the secondary optic. The speed of target acquisition when shifting the aim from the primary optic to the secondary optic is often crucial. In addition, the switch from a primary optic to a secondary optic may occur when there is a malfunction of the primary optic, where the time of switching can also be important. The closer the secondary optic is to the primary optic, by means of offset angle, the faster the shift from the primary optic to the secondary and vice versa, by the user. Therefore, if an accessory mount can be adjusted for the secondary optic, so the secondary optic is as close as possible to the primary optic, useability increases. The separation in distance of the primary and secondary optic can be reduced if the angle of rotation, or offset angle, can be adjusted. The separation in distance of the primary and secondary optic can be reduced if, the distance of the accessory mount from the firearm bore, or in other words from the vertical plane and/or horizontal plane of the firearm barrel, can be adjusted.

DESCRIPTION OF THE PRIOR ART

Usually offset mounts are available at a fixed degree. If an offset mount is a fixed degree then the angle of the mount cannot be adjusted. Many offset mounts are available in a fixed degree of 45 degrees.

Other offset mounts allow for the offset angle to be adjusted where the accessory is attached to part of the mount which rotates about a pivot point.

DETAILED DESCRIPTION OF THE INVENTION

Figure 1:
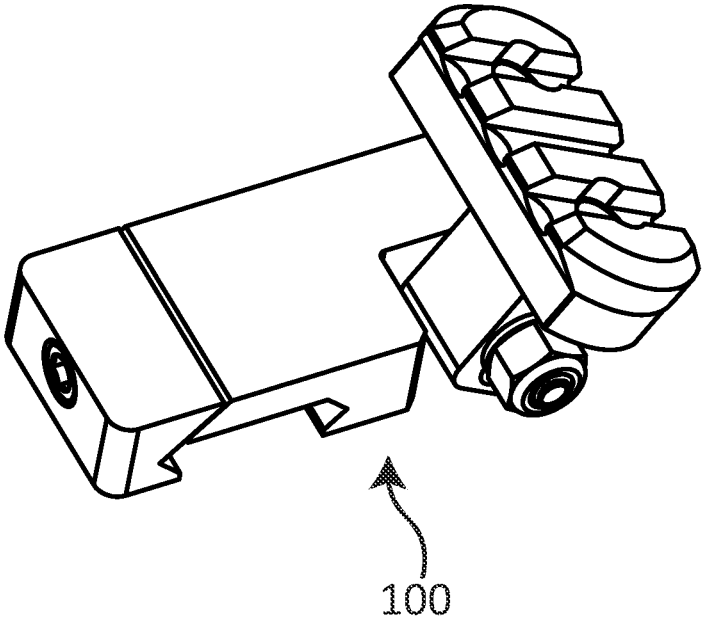
FIG. 1 is a top perspective view of an embodiment of an AOM without a guard.
Figure 2:
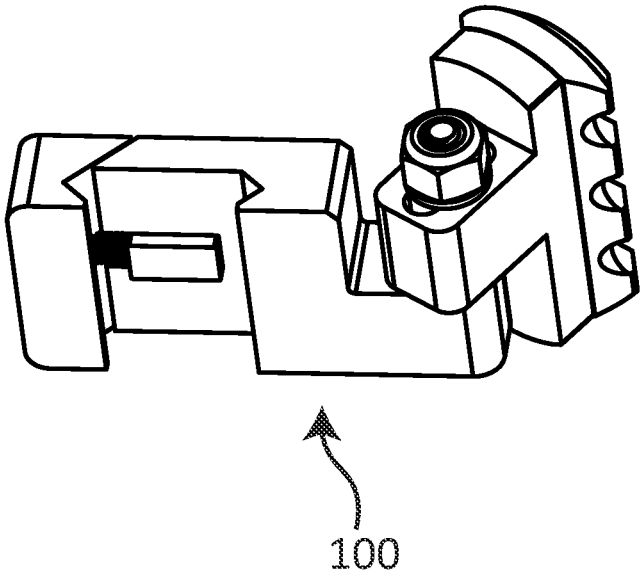
FIG. 2 is a bottom perspective view of an embodiment of an AOM without a guard.
Figure 3:
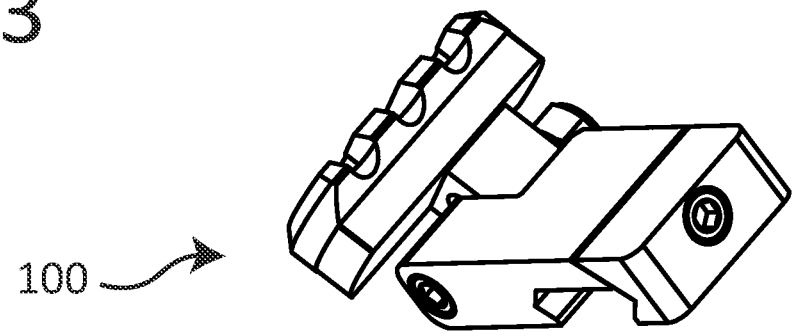
FIG. 3 is a top perspective view of an embodiment of an AOM without a guard.
Figure 4:
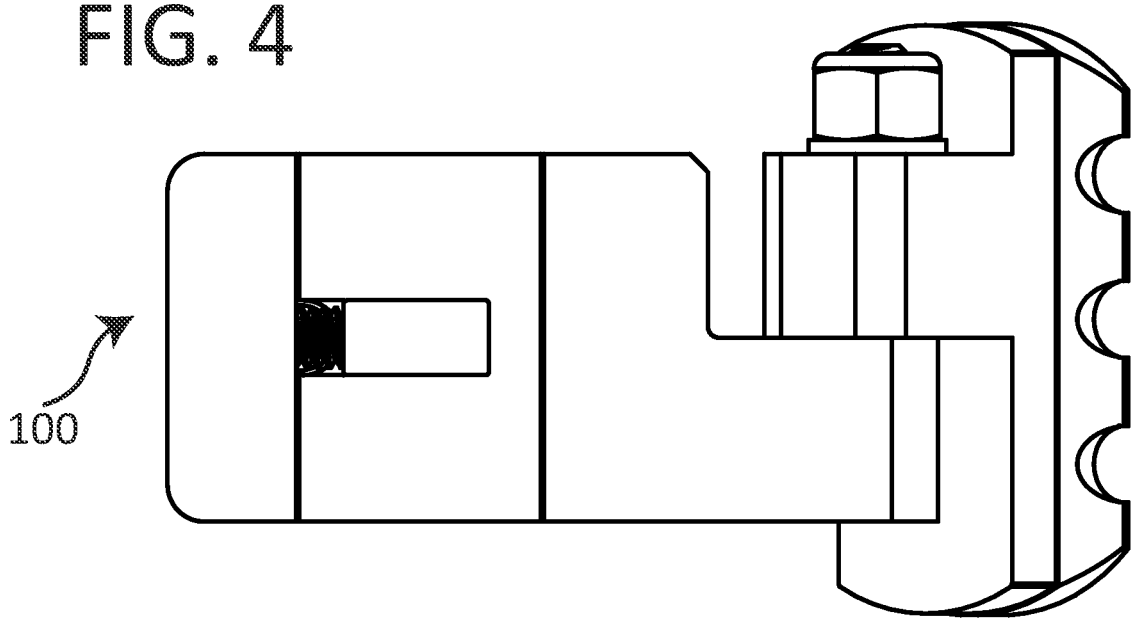
FIG. 4 is a bottom plan view of an embodiment of an AOM without a guard.
Figure 5:
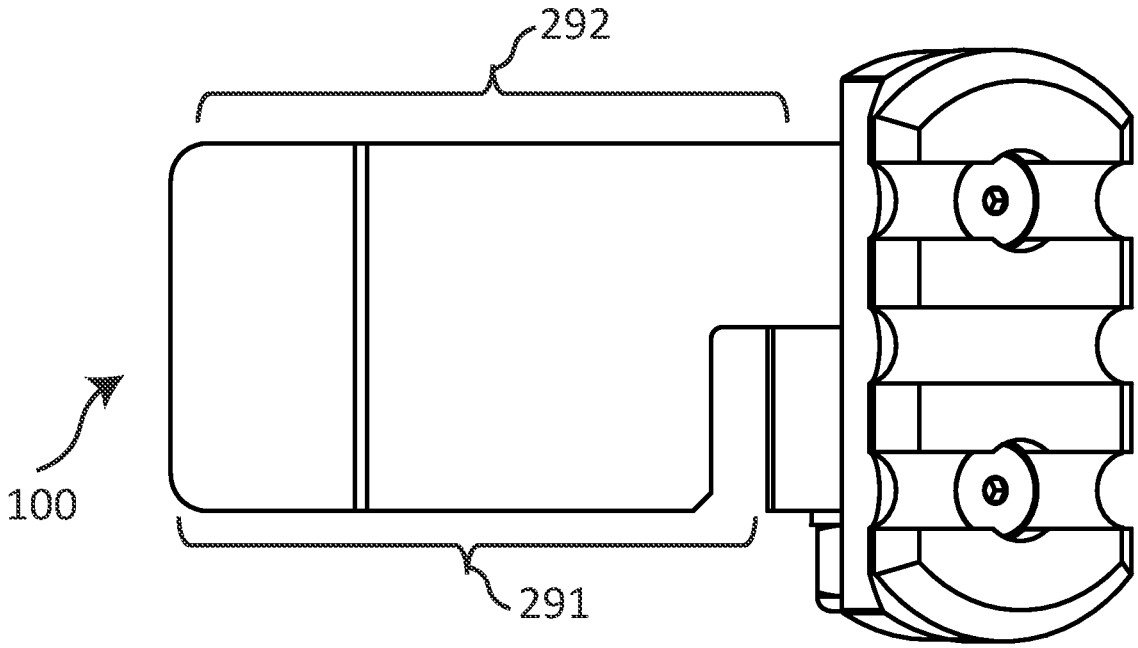
FIG. 5 is a top plan view of an embodiment of an AOM without a guard.
Figure 6:
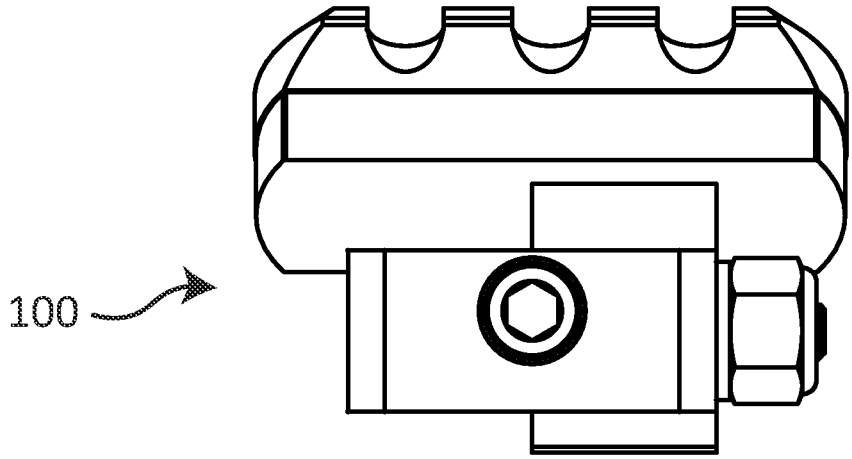
FIG. 6 is a left elevational view of an embodiment of an AOM without a guard.
Figure 7:
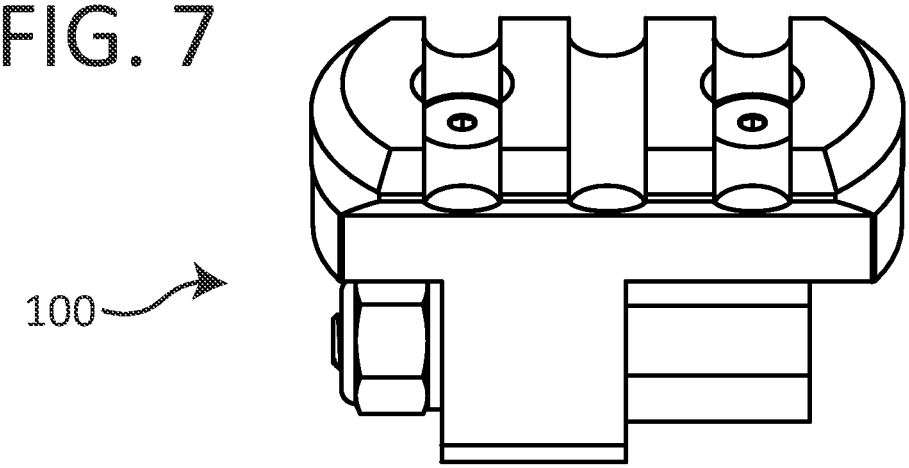
FIG. 7 is a right elevational view of an embodiment of an AOM without a guard.

A firearm can have a main accessory rail attached to the firearm. The main accessory rail is commonly on the top of the barrel. An embodiment of a main accessory rail can be a main accessory Picatinny rail 817, which can also be called a MIL-STD-1913 rail or 2STANAG324 rail. Also the Picatinny rail can be part of a firearm's upper receiver or a handguard. The barrel 816 can attach to the firearm hand rest 820, where the user of the firearm puts their hand, which is the hand which is not pulling the trigger.

The main accessory rail can hold a main accessory which can be an iron sight, a scope, a laser sight, red dot sight, other optic sights, white-light, or other accessories.

A firearm has a barrel 816 where the bullet 818 travels through and exits the opening of the barrel 815. The bullet trajectory 819 travels down the length of the firearm from the rear of the barrel to the front of the barrel. The bullet trajectory 819 travels down the longitudinal axis 804 of the firearm. Other elements of the firearm and attached accessories can be defined by the vertical axis 800 and the horizontal axis 802. The vertical axis 800 defines the barrel vertical plane 810 which runs up and down from the middle of the barrel of the firearm and from rear to front of the barrel. The horizontal axis 802 defines the barrel horizontal plane 811 which runs from left to right in the middle of the barrel and from rear to front of the barrel.

The barrel 816 is attached to the hand rest 820. When the user of the firearm shoots normally one hand is on the hand rest 820 and the other hand is in contact with the trigger and end of the stock connected to the barrel 816.

Commonly attached to the top of the barrel 816 along the barrel longitudinal axis 804 is a main accessory rail. An optic can be attached to the main accessory rail to aid the user of the firearm shoot accurately. Commonly the primary optic is attached to the main accessory rail such as a main accessory Picatinny rail 817. The primary optic is normally attached in a way that the center of the primary optic runs through the barrel vertical plane 810 of the barrel 816. A secondary optic can be attached to the firearm. The secondary optic can be attached to a mount, the mount can be attached to the main accessory rail. The mount can have the secondary optic offset from the barrel vertical plane 810 where the secondary optic is a distance from left or right from the barrel vertical plane 810.

An accessory rail can be attached to the firearm which is not on the top of the barrel, such as on the side or bottom of the barrel. A mount can also be attached to such an accessory rail which is not on the top of the barrel and have a secondary optic offset from such an accessory rail.

An embodiment of a mount which attaches to the main accessory rail on a firearm is the Adjustable Offset Mount (AOM) 100. The AOM removably attaches to the main accessory rail or another rail on a firearm.

Figure 68A:
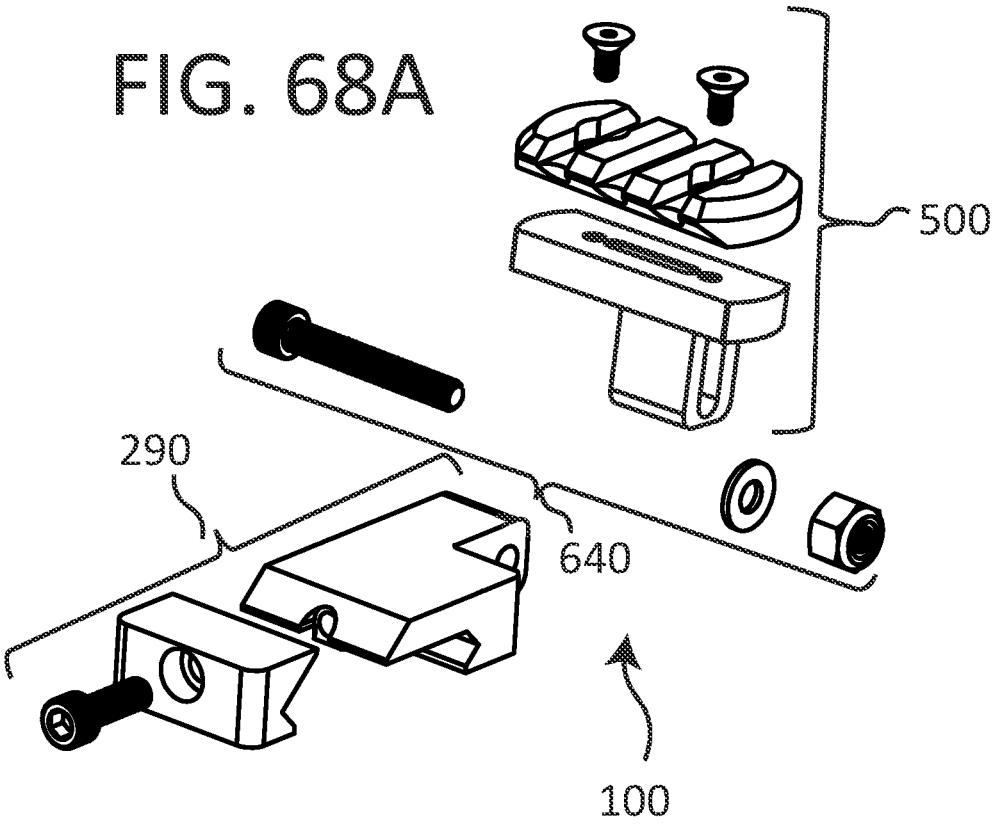
FIG. 68A is an exploded view of an embodiment of an AOM without a guard showing the components of a base structure, a cinch pivot structure, and an extension arm structure.

As in FIG. 68A, an embodiment of the AOM 100 can have three main components of the base structure 290, a cinch pivot structure 640, and an extension arm structure 500. The base structure 290 removably attaches to a main accessory rail on a firearm. The extension arm structure 500 is removably attached to the base structure 290 with the cinch pivot structure 640. A secondary accessory, or also called a secondary optic, is attached to the extension arm structure 500. The extension arm structure 500 can be adjusted to allow the secondary optic to be different offset distances and angles. The extension arm structure 500 can be adjusted to allow the secondary optic to be different distances from the barrel horizontal plane 811. The extension arm structure 500 can be adjusted from a first position to a second position where the first and second position have the same offset angle but the first position has a different offset distance and distance from the barrel horizontal plane 811 as compared to the second position.

An embodiment of a base structure 290 can include a base piece 300, a clamp piece 330, and clamp to base piece screw 331. The base piece 300 can also be called the base. The base piece 300 has a triangular groove running from front to rear of the base piece 300. The triangular groove in the base piece can be called a base piece groove 317. The clamp piece 330 can also be called the clamp. The clamp piece 330 has a triangular groove running from front to rear of the clamp piece 330. The groove in the clamp can be called a clamp groove 336. The clamp to base piece screw 331 removably attaches the base piece 300 to the clamp piece 330. The base piece 300 has a threaded hole with an opening on the left face of the base piece which is in the center of the front to rear distance of the base piece 300. The clamp piece 330 has a non-threaded hole running from the left to right with an opening on the left face of the clamp piece and an opening on the right face of the clamp piece, which can be called a clamp hole 335. The clamp to base piece screw 331 goes through the hole of the clamp piece into the threaded hole in the left face of the base piece and is tightened to connect the clamp piece 330 to the base piece 300. The hole in the left face of the base piece 300 can be called a base piece to clamp hole 318. There is a base piece left face extension overhang 312. There is a base piece left face extension overhang bottom face 313. There is a base piece first angled left face 307. The base piece first angled left face 307 connects to the base piece left face extension overhang bottom face 313. The connection between the base piece first angled left face 307 connects to the base piece left face extension overhang bottom face 313 forms the base piece pointed edge 315. There is a base piece second angled left face 308 and a base piece third angled left face 309. The base piece left face extension overhang bottom face 313 connects to the base piece second angled left face 308. The base piece second angled left face 308 connects to the base piece third angled left face 309. The base piece second angled left face 308 and the base piece third angled left face 309 forms the base piece groove 317.

The base piece left face extension overhang bottom face 313 has a base piece left face extension overhang bottom face ridge 314. The base piece left face extension overhang bottom face ridge 314 runs from left to right and is configured to engage into a groove in main accessory Picatinny rail 817. The base piece left face extension overhang bottom face ridge 314 keeps the base piece 300 from moving in a longitudinal direction related to the firearm.

Figure 53:
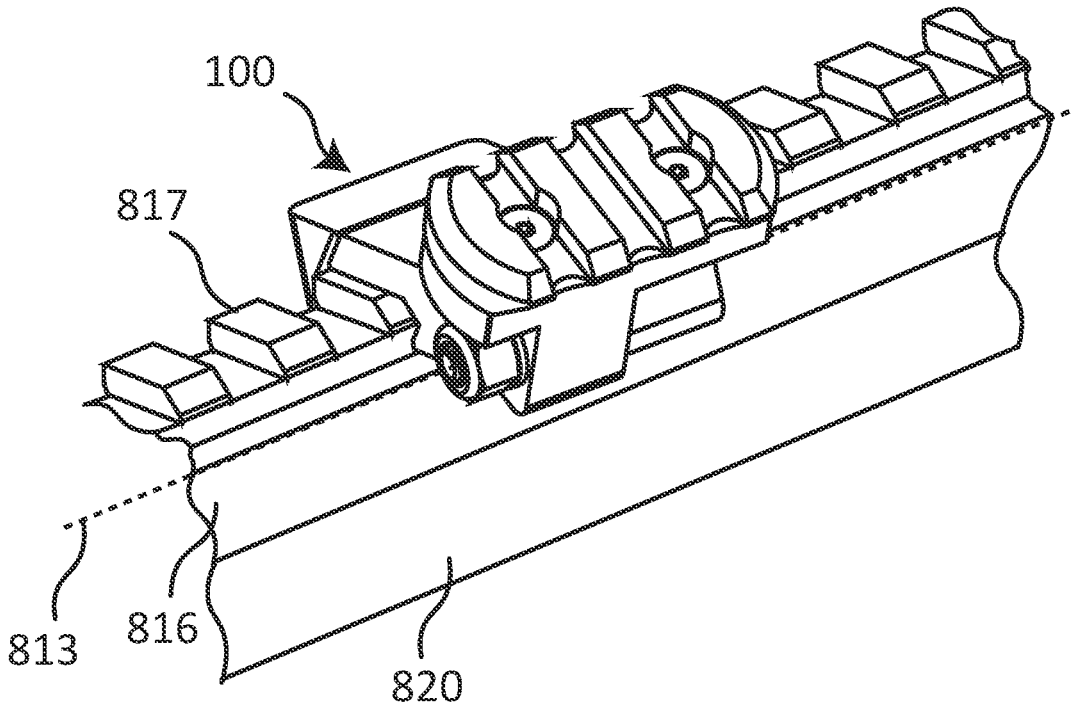
FIG. 53 top perspective view of part of a firearm with a Picatinny rail on top of the barrel with an embodiment of an AOM without a guard attached to the Picatinny rail.

The clamp to base piece screw 331 can be a Hex Cap #8-32×0.5 screw. The triangular groove of the base piece and the triangular groove of the clamp piece removably attach to sides of main accessory rail of the firearm, which can be a main accessory Picatinny rail 817, as in FIG. 53.

The base piece 300 has a base hole 301 which is a hole without threads and runs from the front to rear so there is an opening on the front face of the base piece and the rear face of the base piece.

Figure 10A:
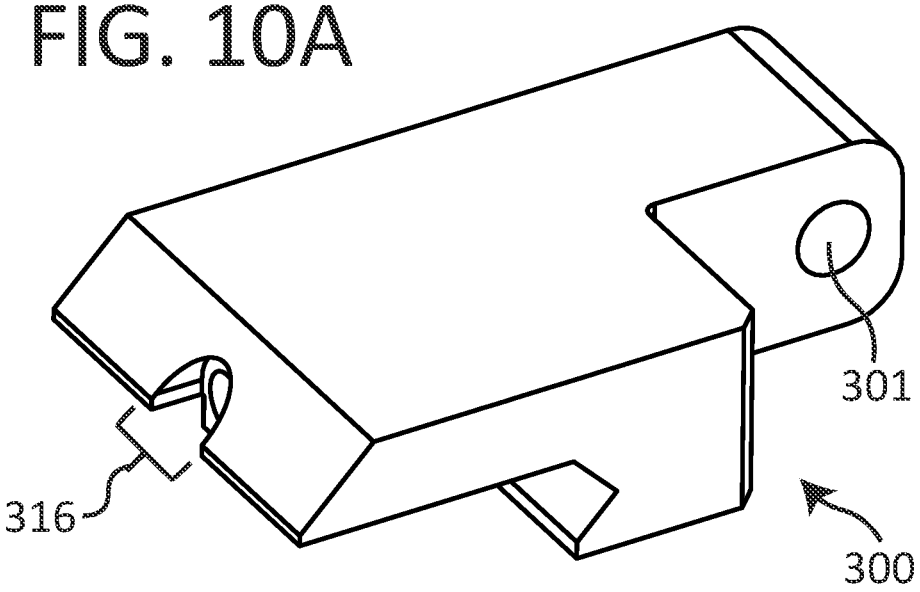
FIG. 10A is a front top perspective view of an embodiment of a base piece.
Figure 10B:
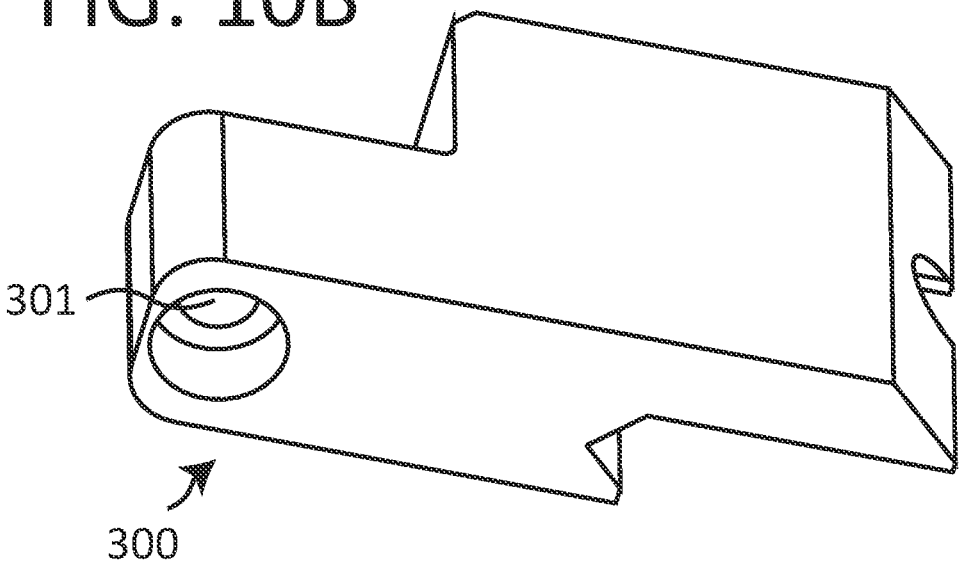
FIG. 10B is a rear top perspective view of an embodiment of a base piece.
Figure 11:
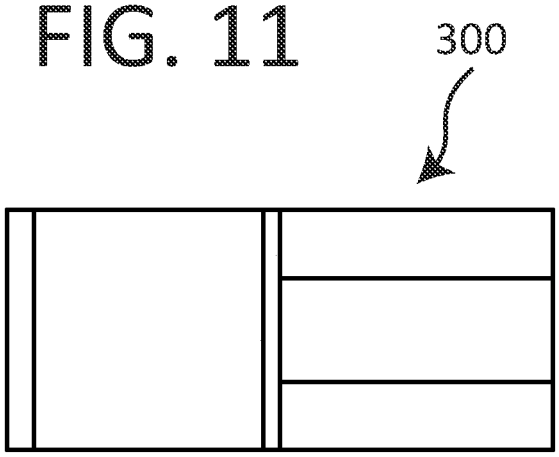
FIG. 11 is a right elevational view of an embodiment of a base piece.
Figure 12:
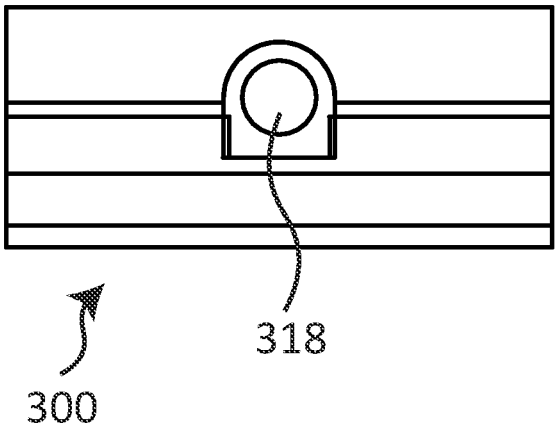
FIG. 12 is a left elevational view of an embodiment of a base piece.
Figure 13:
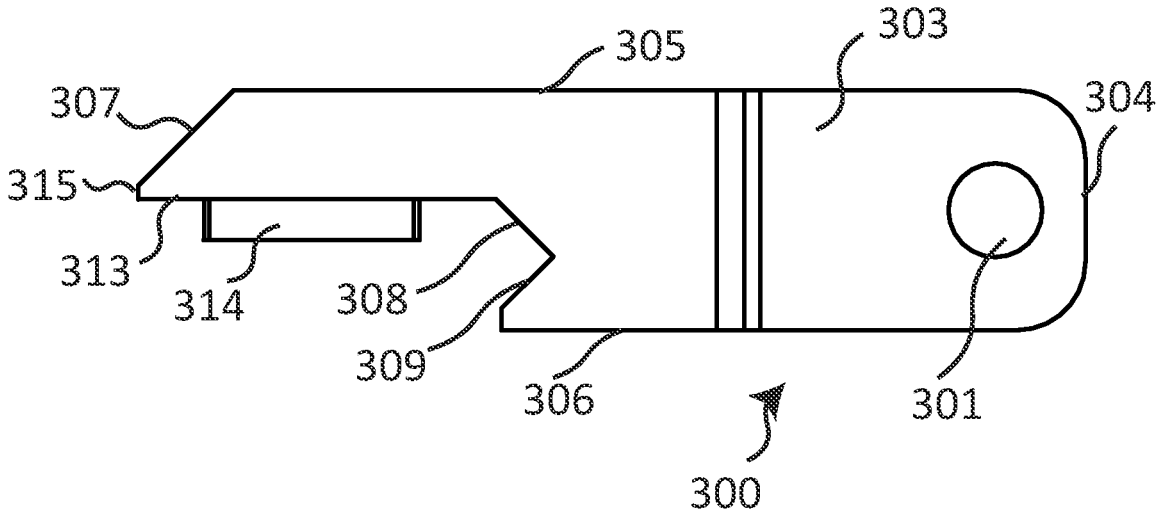
FIG. 13 is a front elevational view of an embodiment of a base piece.
Figure 14:
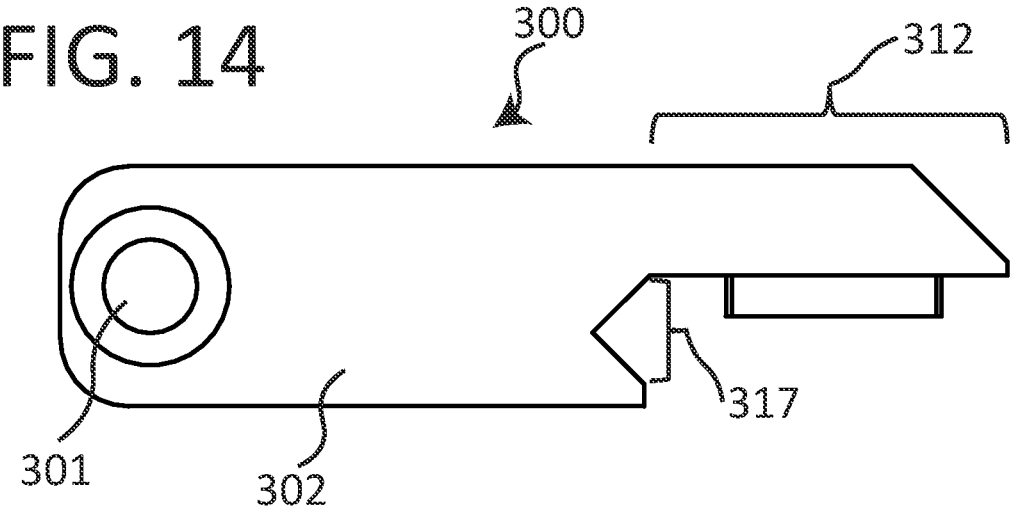
FIG. 14 is a rear elevational view of an embodiment of a base piece.
Figure 15:
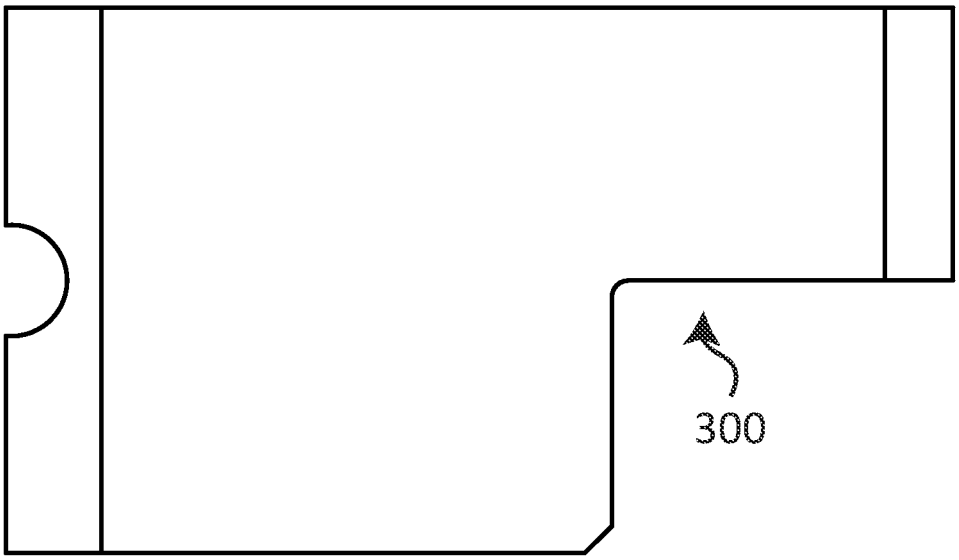
FIG. 15 is a top plan view of an embodiment of a base piece.
Figure 16:
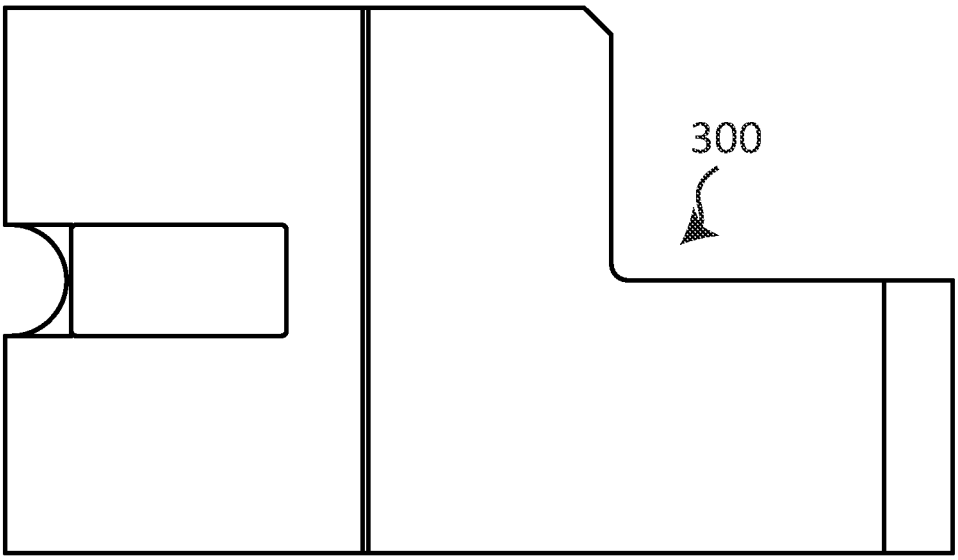
FIG. 16 is a bottom plan view of an embodiment of a base piece.
Figure 17:
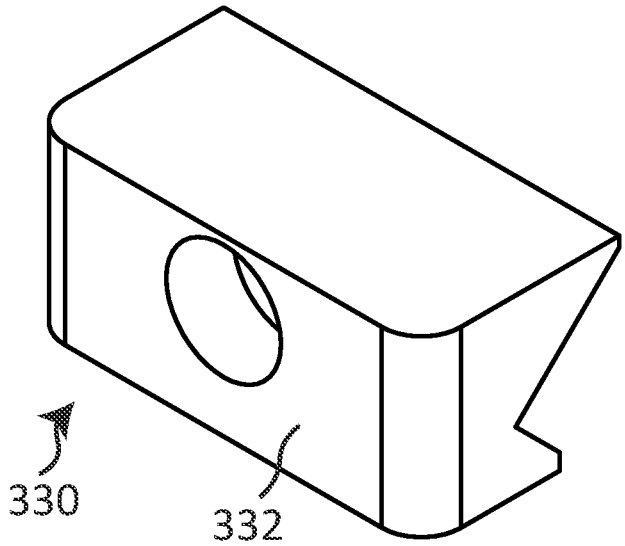
FIG. 17 is a perspective top view of an embodiment of a clamp piece.
Figure 18:
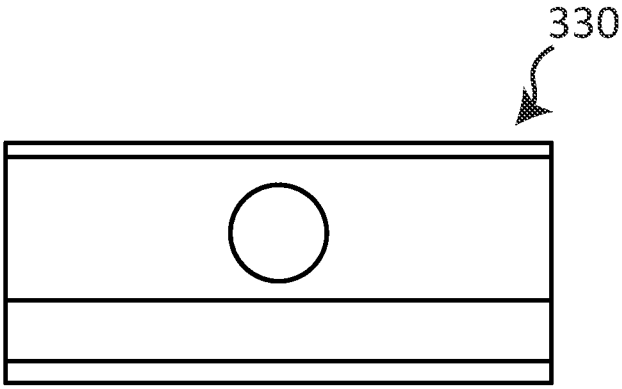
FIG. 18 is a right elevational view of an embodiment of a clamp piece.
Figure 19:
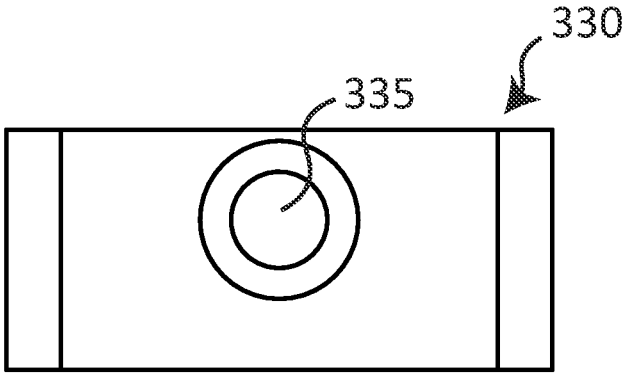
FIG. 19 is a left elevational view of an embodiment of a clamp piece.
Figure 20:
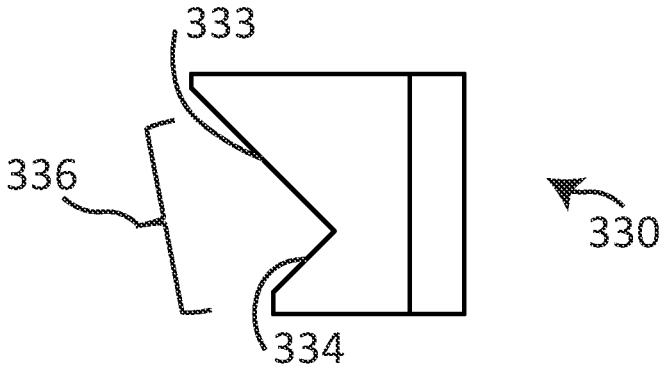
FIG. 20 is a rear elevational view of an embodiment of a clamp piece.
Figure 21:
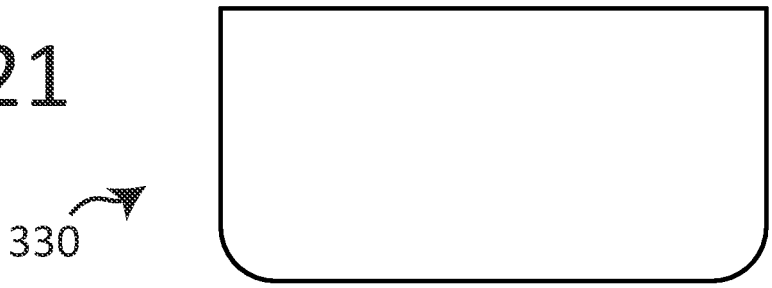
FIG. 21 is a top plan view of an embodiment of a clamp piece.
Figure 22:
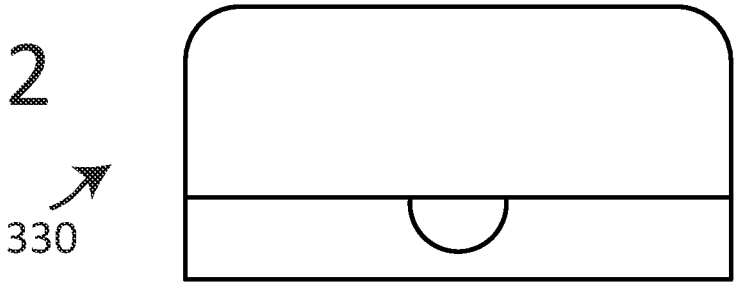
FIG. 22 is a bottom plan view of an embodiment of a clamp piece.

The base piece 300 can be defined as having: base piece rear face 302, base piece front face 303, base piece right face 304, base piece top face 305, base piece bottom face 306, base piece first angled left face 307, base piece second angle left face 308, base piece third angled left face 309, base piece left face extension overhang 312, base piece left face extension overhang bottom face 313, base piece left face extension overhang bottom face ridge 314, base piece pointed edge 315, base piece first left angle face cutaway 316, base piece groove 317, and base piece to clamp hole 318. The base piece front face 303 can be defined as any part of the front face which can include, a non-cut back section, and a cut back section which includes the base hole 301 such as seen in the top perspective view of the embodiment of the base piece 300 as depicted in FIG. 10A.

A different embodiment of the base structure 290 can include a base piece with threaded pivot attachment 310, a clamp piece 330, and clamp to base piece screw 331. The base piece with threaded pivot attachment 310 is the same at the base piece 300 expect the base piece with threaded pivot attachment 310 does not have a base hole 301. The base piece with threaded pivot attachment 310 has an insert reinforced threaded hole 311. The insert reinforced threaded hole 311 runs front to rear. In an embodiment of the base piece with threaded pivot attachment 310 the insert reinforced threaded hole 311 only has one opening on the front face of the base piece with threaded pivot attachment 310. The hole for attachment of the extension arm structure in the base piece with threaded pivot attachment 310 can be threaded but not reinforced. The base piece with threaded pivot attachment 310 connects to the clamp piece 330 with the clamp to base piece screw 331 the same way as the base piece 300 connects to the clamp piece 330 with the clamp to base piece screw 331.

The base structure can be defined as having: base structure front face 291 and a base structure rear face 292. The rear face of the base piece and the rear face of the clamp piece forms the rear face of the base structure. The front face of the base piece and the front face of the clamp piece forms the front face of the base structure.

The clamp piece can be defined as having: clamp piece left face 332, clamp piece first angled right face 333, clamp piece second angled right face 334, clamp hole 335, and clamp groove 336. The clamp piece first angled right face 333 and the clamp piece second angled right face 334 forms the clamp groove 336.

An embodiment of the base piece 300 or a base piece with threaded pivot attachment 310 can have measurements of: 1 inch from the rear edge to the front edge; 0.44 inches from top edge to bottom edge, and 1.735 inches from the left edge to the right edge.

An embodiment of the clamp piece 330 can have measurements of: 1 inch from the rear edge to the front edge; 0.44 inches from top end to bottom edge, and 0.5 inches from the left edge to the right edge.

An embodiment of the extension arm structure 500 has two elements of the extension arm and an accessory mounting plate. There can be an extension arm without a guard 501 and an extension arm with a guard 550. The extension arm with a guard 550 can also be called an extension arm configured for a guard to removably attach to the extension arm. The elongated slot hole in the extension arm allows for adjustments in the offset angle and the distance of the accessory from the firearm bore, explained further below. An embodiment of the elongated slot hole is a hole with two openings with one opening on the rear face of the extension arm and the second opening on the front face of the extension arm. The elongated slot hole has a cross section which has a wider distance from top to bottom than left to right when the extension arm is in zero degrees of offset angle, where offset angle is defined further below. The position or orientation of the cinch pivot structure within the elongated slot will have the extension arm in different positions. In an embodiment of the elongated slot hole the longer sides of the elongated slot are flat where the cinch pivot structure can be moved in a straight line from one end of the elongated slot hole to the other end of the elongated slot hole. In an embodiment of the elongated slot hole the diameter of the smaller width of a cross section of the elongated is slightly larger than the main body of the cinch pivot structure, where a cinch pivot structure is explained more below. When the diameter of the smaller width of a cross section of the elongated slot hole is slightly larger than the main body of the cinch pivot structure, the main body of the pivot cinch structure will remain securely in the elongated slot hole and generally only allow movement of the main body of the cinch pivot structure, when the cinch pivot structure is loosened, in the direction of the longer width of the cross section of the elongated slot hole.

Figure 23:
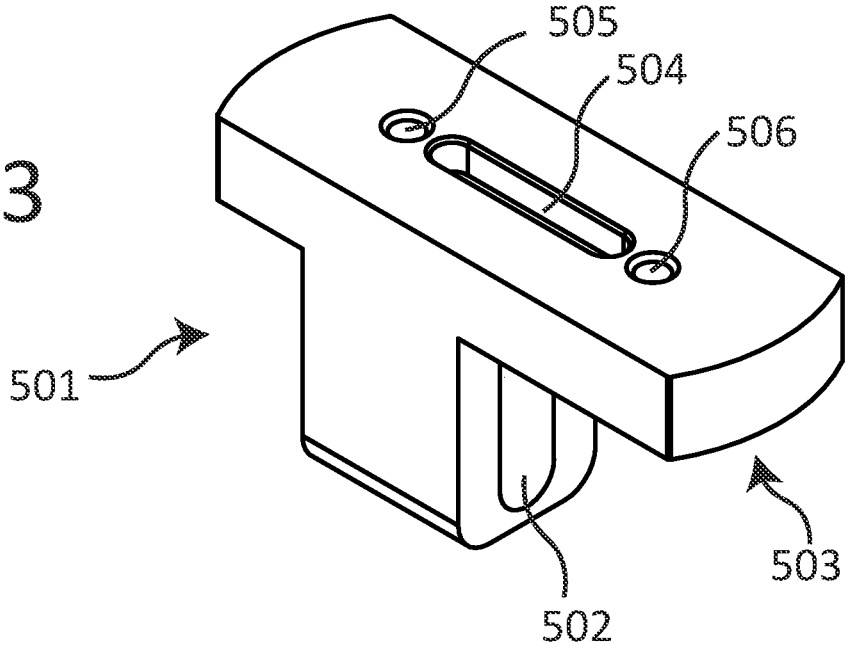
FIG. 23 is a top perspective view of an embodiment of an extension arm without a guard.

An embodiment of an extension arm without a guard 501 as in FIG. 23 has: an elongated slot hole of an extension arm without a guard 502; an accessory mounting plate base of an extension arm without a guard 503; a mortise hole of an extension arm without a guard 504; a first screw hole for accessory mounting plate attachment without a guard 505; and a second screw hole for accessory mounting plate attachment without a guard 506.

Further, the extension arm without a guard 501 can be described as: the extension arm without a guard front face 507, the extension arm without a guard rear face 508, the extension arm without a guard bottom face 509, and the extension arm without a guard top face 510.

An embodiment of an extension arm with a guard 550 as in FIG. 36-39 has: an elongated slot hole of an extension arm with a guard 551; an accessory mounting plate base of an extension arm with a guard 552; a mortise hole of an extension arm with a guard 559; a first screw hole for accessory mounting plate attachment with a guard 557; a second screw hole for accessory mounting plate attachment with a guard 558; a first guard hole 553; a second guard hole 554, a first guard screw hole 555, and a second guard screw hole 556.

An embodiment of the extension arm without a guard 501 or extension arm with a guard 550 can have measurements of: 1.6 inches from the rear edge to the front edge of the accessory mounting plate base; 0.5 inches from the rear edge to the front edge of the extension arm which is not the accessory mounting plate base, 0.85 inches from top edge to bottom edge including the accessory mounting plate base, 0.56 inches from left edge to right edge of the accessory mounting plate base; 0.44 inches from left edge to right edge of the extension arm which is not the accessory mounting plate base; 0.514 inches from the top edge to the bottom edge of the elongated slot hole, 0.174 inches from the left edge to the right edge of the elongated slot hole; 0.23 inches from the top edge to the bottom edge of the accessory mounting plate base.

When dimensions are provided and described as an edge that can also mean the face of the element. The use of edge as the description of the measurement is provided so if the end of the measurement hits a corner or a face, the use of edge will apply to both.

An accessory mounting plate attaches to embodiments of the extension arm by connecting to an accessory mounting plate base of an extension arm without a guard 503 or an accessory mounting plate base of an extension arm with a guard 552. The accessory mounting plate base is at one end of the extension arm. Embodiments of the accessory mounting plate base can be a widened extension of the extension arm, where the accessory mounting plate base gives more surface area for the accessory mounting plate to attach. The accessory mounting plate base can have screw holes for accessory mounting plate attachment. The accessory mounting plate base can be considered part of the extension arm.

An accessory mounting plate can have more than one form (other types of rails other than a Picatinny). An embodiment of an accessory mount plate is a three slot Picatinny rail accessory mounting plate 601. The three slot Picatinny rail accessory mounting plate 601 can also be called a 3 slot Picatinny rail. An embodiment of a three slot Picatinny rail accessory mounting plate 601 has: a first accessory mounting plate hole 602; a second accessory mounting plate hole 603; and an accessory mount plate tenon 604.

An embodiment of three slot Picatinny rail accessory mounting plate 601 can attach to an extension arm without a guard 501 or an extension arm with a guard 550 with a first accessory mounting plate attachment screw 605 and a second accessory mounting plate attachment screw 606.

For an extension arm without a guard 501 the three slot Picatinny rail accessory mounting plate 601 attaches, where the first accessory mounting plate attachment screw 605 goes through the first accessory mounting plate hole 602 of the three slot Picatinny rail accessory mounting plate 601 and into the first screw hole for accessory mounting plate attachment without a guard 505 of the extension arm without a guard 501; where the second accessory mounting plate attachment screw 606 goes through the second accessory mounting plate hole 603 of the three slot Picatinny rail accessory mounting plate 601 and into the second screw hole for accessory mounting plate attachment without a guard 506 of the extension arm without a guard 501; and where the accessory mounting plate tenon 604 of the three slot Picatinny rail accessory mounting plate 601 goes into the mortise hole of an extension arm without a guard 504 of the extension arm without a guard 501.

For an extension arm with a guard 550 the three slot Picatinny rail accessory mounting plate 601 attaches, where the first accessory mounting plate attachment screw 605 goes through the first accessory mounting plate hole 602 of the three slot Picatinny rail accessory mounting plate 601 and into the first screw hole for accessory mounting plate attachment with a guard 557 of the extension arm with a guard 550; where the second accessory mounting plate attachment screw 606 goes through the second accessory mounting plate hole 603 of the three slot Picatinny rail accessory mounting plate 601 and into the second screw hole for accessory mounting plate attachment with a guard 558 of the extension arm without a guard 550; and where the accessory mounting plate tenon 604 of the three slot Picatinny rail accessory mounting plate 601 goes into the mortise hole of an extension arm with a guard 559 of the extension arm with a guard 550.

In an embodiment, the first and second accessory mounting plate attachment screw 605, 606 can each be a Cross/Philips #4-40×¼ inch screw.

An embodiment of the three slot Picatinny rail accessory mounting plate 601 can have measurements of: 1.61 inches from front edge to rear edge; 0.833 inches from left edge to right edge; and 0.25 inches from top edge to bottom edge not including the tenon.

Figure 68B:
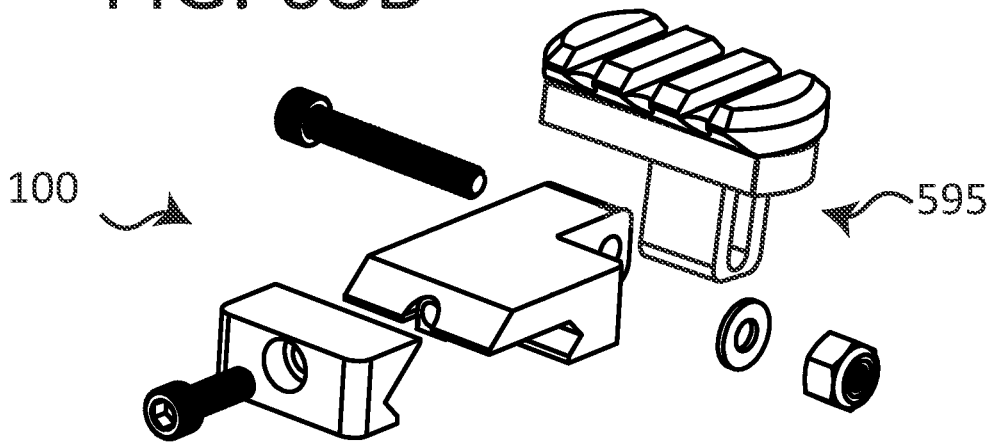
FIG. 68B is an exploded view of an embodiment of an AOM without a guard and the extension arm does not have a separate mounting plate attached to the end of the extension arm.

An embodiment of the extension arm can have the accessory mount pre-molded into the end of the extension arm such as a Picatinny rail molded into to the end of the extension arm. In an extension arm with the accessory mount pre-molded into the end of the extension arm there is not a separate accessory mounting plate or screws to attach the plate and the extension arm may have a widened end that is like other embodiments with an accessory mounting plate base, but the widened element is not attaching to another separate piece of the accessory mounting plate. An example of the extension arm without an attached accessory plate 595 as part of an embodiment of an AOM 100, in an exploded view, is seen in FIG. 68B.

A cinch pivot structure 640 attaches the base structure 290 to the extension arm structure 500 and keeps the extension arm structure 500 in the desired position when tightened. The cinch pivot structure 640 can be loosened and then the position of the extension arm structure 500 can be adjusted into a different position and then the cinch pivot structure 640 can be tightened to keep the extension arm structure 500 in the desired position.

The cinch pivot structure 640 can be described as having three main parts: the cinch pivot structure first end section 641, cinch pivot structure main body 643, and cinch pivot structure second end section 642. The cinch pivot structure first end section 641 connects to the cinch pivot structure main body 643. The cinch pivot structure main body 643 connects to the cinch pivot structure second end section 642. The cinch pivot structure first end section 641 attaches to the base structure 290. The cinch pivot structure first end section 641 can be a head of a bolt. When the cinch pivot structure first end section 641 is said to attach to the base structure 290 the attachment of the head of the bolt can be in contact with the base structure and held in place by pressure. The cinch pivot structure first end section 641 can be a threaded end of a bolt and the attachment of the threaded end of the bolt can be into a threaded hole.

Embodiments of a cinch pivot structure 640 can include a pivot bolt 650. An embodiment of the pivot bolt 650 has threads running down the complete shaft of the bolt, where the threads for the entire length of the bolt might not be engaged with corresponding threads when in use. The pivot bolt can have a hex engagement end, or a hex shaped hole at one end, for tightening. The hex engagement end can also be called the pivot bolt head 651. The pivot bolt 650 can also be called a pivot screw. The pivot bolt 650 can be a Hex Cap #8-32×1 and ⅛ inch screw. The pivot bolt 650 can be described as having: a pivot bolt head 651, pivot bolt shaft 652, and pivot bolt end threaded section 653. The pivot bolt head 651 connects to the pivot bolt shaft 652. The pivot bolt shaft 652 connects to the pivot bolt end threaded section 653.

Embodiments of a cinch pivot structure 640 can include a nylon insert lock nut 670. There are metal threads of the nylon insert lock nut 673, which run from the rear of the hole in the nut to almost the front of the hole of the nut. At the front of the hole of the nylon insert lock nut 670 there is a nylon insert 671. The nylon insert 671 runs around the circumference of the opening of the hole in the front of the nylon insert lock nut 670. The nylon insert 671 only goes partially back to the rear of the hole so the metal threads of the nylon insert lock nut 673 are exposed for most of the hole. The nylon insert 671 when tightened into the threads of a corresponding bolt keeps the nut in position better than a regular nut by deforming and causing pressure for the nylon insert lock nut 670 to stay in place. Embodiments of the nylon insert lock nut 670 can be an 8-32 thread size. A washer 685 is oriented in between the nylon insert lock nut 670 and the extension arm. The cinch pivot structure first end section 641 is the head of the pivot bolt head 651. The cinch pivot structure main body 643 is pivot bolt shaft 652. The cinch pivot structure second end section 642 is the pivot bolt end threaded section 653, washer 685, and nylon insert lock nut 670.

Embodiments of a cinch pivot structure 640 can include a nut 672. The nut 672 is configured where the metal threads of the nut 674 run for the entire length of the hole of the nut.

Embodiments of a cinch pivot structure 640 can include a spring washer 686. The spring washer 686 is a washer with a break in the circular form of the washer where the ends of the washer are bent in a forward and rear position. When a nut 672 is tightened down on the spring washer 686 the bend structure compresses and causes tension to keep the nut 672 in position better than without the spring washer 686.

An embodiment of a cinch pivot structure 640 can be a pivot bolt 650, a nylon insert lock nut 670, a washer 685. The base structure 290 is removably attached the extension arm structure 500 with the embodiment of the cinch pivot structure 640. This cinch pivot structure 640 can be used with a base piece 300 which has a base hole 301 which does not have threads. The pivot bolt 650 goes through the base hole 301 in the base piece 300. The hex end of the pivot bolt 650 is configured next to the rear face of the base piece 300. The threaded end of the pivot bolt 650 is configured to go through the base hole 301 and out the front face of the base piece 300, then into and then out the front face of the elongated slot hole of the extension arm. Then the pivot bolt goes through a washer 685 and into a nylon insert lock nut 670. The nylon insert 671 is oriented away from the extension arm. The nylon insert lock nut 670 is then tightened to keep the extension arm in place. When the nylon insert lock nut 670 is loosened the extension arm position can be changed. Then the nylon insert lock nut 670 is then re-tightened to keep the extension arm in the new position. This cinch pivot structure 640 can be used with an extension arm without a guard 501 or an extension arm with a guard 551.

An embodiment of a cinch pivot structure 640 can be a pivot bolt 650, a nut 672, a spring washer 686, and a washer 685. This cinch pivot structure 640 can be used with a base piece 300 which has a base hole 301 which does not have threads. The pivot bolt 650 goes through the base hole 301 in the base piece 300. The hex end of the pivot bolt 650 is configured next to the rear face of the base piece 300. The threaded end of the pivot bolt 650 is configured to go through the base hole 301 and out the front face of the base piece 300, then into and then out the front face of the elongated slot hole of the extension arm. Then the pivot bolt goes through, a washer 685, then a spring washer 686, and into a nut 672. The nut 672 is then tightened to keep the extension arm in place. When the nut 672 is loosened the extension arm position can be changed. Then the nut 672 is then re-tightened to keep the extension arm in the new position. This cinch pivot structure 640 can be used with an extension arm without a guard 501 or an extension arm with a guard 551. In this above described embodiment, the cinch pivot structure first end section 641 is the head of the pivot bolt head 651. The cinch pivot structure main body 643 is pivot bolt shaft 652. The cinch pivot structure second end section 642 is the pivot bolt end threaded section 653, washer 685, spring washer 686, and nut 672.

An embodiment of a cinch pivot structure 640 can be a pivot bolt 650, a nut 672, and a spring washer 686. This configuration is the same in all ways as a cinch pivot structure 640 of a pivot bolt 650, a nut 672, a spring washer 686, and a washer 685, except the washer 685 is excluded in the configuration. In this above described embodiment, the cinch pivot structure first end section 641 is the head of the pivot bolt head 651. The cinch pivot structure main body 643 is pivot bolt shaft 652. The cinch pivot structure second end section 642 is the pivot bolt end threaded section 653, spring washer 686, and nut 672.

An embodiment of a cinch pivot structure 640 can be an asymmetric end lever bolt structure 690. The asymmetric end lever bolt structure 690 has an asymmetric end lever pivot bolt 691, attachment asymmetric end lever pin 692, and an asymmetric end lever 693. The asymmetric end lever pivot bolt 691 can be described as having: asymmetric end lever bolt head 694, asymmetric end lever bolt shaft 695, and asymmetric end lever bolt end section 696. The asymmetric end lever bolt head 694 connects to the asymmetric end lever bolt shaft 695. The asymmetric end lever bolt shaft 695 connects asymmetric end lever bolt end section 696. The attachment asymmetric end lever pin 692 attaches the asymmetric end lever 693 to the asymmetric end lever pivot bolt 691. The attachment asymmetric end lever pin 692 goes through the asymmetric end lever bolt end section 696. The asymmetric end lever 693 rotates around the attachment asymmetric end lever pin 692. When the asymmetric end lever 693 is in the non-tightened position the asymmetric end lever 693 does not clamp down on another structure. When the asymmetric end lever 693 is in a tightened position the asymmetric end lever 693 does clamp down on another structure. The asymmetric end lever bolt structure 690 can be used with a base piece 300 which has a base hole 301 which does not have threads. The AOM is manufactured where, the pivot bolt 650 goes through the base hole 301 in the base piece 300. The asymmetric end lever bolt head 694 is configured next to the rear face of the base piece 300. The other end of the asymmetric end lever pivot bolt 691 is configured to go through the base hole 301 and out the front face of the base piece 300, then into and then out the front face of the elongated slot hole of the extension arm. The asymmetric end lever 693 is configured on the front face of the extension arm structure, where the asymmetric end lever 693 can be put in the tightened position to hold the extension arm structure in place. Also the asymmetric end lever 693 can be put in the non-tightened position and the extension arm can be moved, and then the asymmetric end lever 693 can be put in the tightened position to keep the extension arm in place for the new position. This cinch pivot structure 640 can be used with an extension arm without a guard 501 or an extension arm with a guard 551. In this above described embodiment, the cinch pivot structure first end section 641 is the asymmetric end lever bolt head 694. The cinch pivot structure main body 643 is the asymmetric end lever bolt shaft 695. The cinch pivot structure second end section 642 is the asymmetric end lever bolt end section 696, attachment asymmetric end lever pin 692, and an asymmetric end lever 693.

The asymmetric end lever bolt structure 690 can also be called a quick release lever. The asymmetric end lever bolt structure 690 can have different embodiments such as a threaded end instead of a head, or other threaded elements for adjustment of tension.

The washer 685 can be described as a washer front face 665 and a washer rear face 666.

The spring washer 686 can be described as a spring washer front face 667 and a spring washer rear face 668

An embodiment of a cinch pivot structure 640 can be a pivot bolt 650 and a washer 685. This cinch pivot structure 640 can be used with a base piece with threaded pivot attachment 310 which has an insert reinforced threaded hole 311. The pivot bolt 650 goes through the washer 685. The hex end of the pivot bolt 650 is configured next to the front face of the washer 685. The rear face of the washer 685 is configured next to the front face of the extension arm. The threaded end of the pivot bolt 650 is configured to then go into and then out the rear face of the elongated slot hole of the extension arm and then into the insert reinforced threaded hole 311 in the front face of the base piece with threaded pivot attachment 310. The pivot bolt 650 is tightened to keep the extension arm in place. The pivot bolt 650 can be loosened and the extension arm then adjusted in position and the pivot bolt 650 then re-tightened in the new position. If a position of the extension arm is desired and no further adjustment is needed a thread locking liquid can be used to keep the pivot bolt 650 more securely in position. This cinch pivot structure 640 can be used with an extension arm without a guard 501 or an extension arm with a guard 551. In this above described embodiment, the cinch pivot structure first end section 641 is the pivot bolt end threaded section 653. The cinch pivot structure main body 643 is the pivot bolt shaft 652. The cinch pivot structure second end section 642 is the washer 685 and pivot bolt head 651.

The cinch pivot structure 640 of a pivot bolt 650, washer 685, and a nylon insert lock nut 670 can be considered the best embodiment of the cinch pivot structure 640 for keeping the extension arm structure 500 in place because the tightening of the nylon insert lock nut 670 holds the position of the extension arm structure 500, the nylon insert 671 keeps the nylon insert lock nut 670 in place after repeated vibration or use, there is no damage to the surface of the extension arm structure like scratching, and no extra materials are needed such as a liquid thread locker. Although the nylon insert lock nut 670 has the disadvantage of the nylon insert 671 wearing out with repeated loosening and retightening because there is deformation the nylon insert 671. The cinch pivot structure of pivot bolt 650, washer 685, a spring washer 686, and a nut 672 is a good option for the pivot cinch structure because the tightening of the nut 672 holds the position of the extension arm structure 500, the spring washer 686 keeps the nut 672 in place after repeated vibration or use, there is no damage to the surface of the extension arm structure like scratching, but a user might find that using extra materials as a liquid thread locker on the threads of the pivot bolt 650 and nut 672 may be helpful for even longer secured attachment of the nut 672. The cinch pivot structure of pivot bolt 650, a spring washer 686, and a nut 672 is a good option for the cinch pivot structure because the tightening of the nut 672 holds the position of the extension arm structure 500, the spring washer 686 keeps the nut 672 in place after repeated vibration or use, although there is the disadvantage of the spring washer 686 directly on the extension arm structure 500 can scratch the surface of the extension arm especially if the extension arm is aluminum and anodized with a color and also a user might find that using extra materials as a liquid thread locker on the threads of the pivot bolt 650 and nut 672 may be helpful for even longer secured attachment of the nut 672. The cinch pivot structure of pivot bolt 650 and a washer 685 screwed into an insert reinforced thread hole 311 of a base piece with threaded pivot attachment 310 is a good option for the cinch pivot structure because the tightening of the pivot bolt 650 holds the position of the extension arm structure 500, there is no damage to the surface of the extension arm structure like scratching, but if the pivot bolt is overtightened the insert reinforced threaded hole 311 can be damaged which damages a major element of the AOM, which is the base piece with threaded pivot attachment 310. The cinch pivot structures 640 which use hardware like bolts and nuts, those elements can be more easily replaced if needed. The cinch pivot structure 640 of an asymmetric end lever bolt structure 690 is a good option for the cinch pivot structure 640 because the tightening of the asymmetric end lever 693 holds the position of the extension arm structure 500, but likely this cinch pivot structure 640 holds the extension arm structure 500 in place the least securely compared to the other cinch pivot structures 640. The washer 685 generally prevents scratching of the surface of the extension arm structure 500.

A guard can be removably attached to an embodiment of an extension arm with a guard 550. A guard protects the secondary accessory attached to the accessory mounting plate. The protection can be from physical impact from striking an object when the firearm is in use. An embodiment of a guard is a wire guard 750.

An embodiment of the wire guard 750 has: a central bend 751; a first leg 752; and a second leg 753. An embodiment of the first leg 752 has a first bend of the first leg 756 and a second bend of the first leg 758. An embodiment of the first leg 752 has a first bend of the first leg 756 with a 90 degree angle and a second bend of the first leg 758 with a 145 degree angle. An embodiment of the second leg 753 has a first bend of the second leg 757 and a second bend of the second leg 759. An embodiment of the second leg 753 has a first bend of the second leg 757 with a 90 degree angle and a second bend of the second leg 759 with a 145 degree angle.

The angles of the bends can be different in different embodiments.

A wire guard 750 can be removably attached to an embodiment of an extension arm with a guard 550 where the first leg 752 of the wire guard 750 goes through the first guard hole 553 of the extension arm with a guard 550 and the second leg 753 of the wire guard 750 goes through the second guard hole 554 of the extension arm with a guard 550.

The first leg 752 of the wire guard 750 and the second leg 753 of the wire guard 750 are held in place by friction of a separate screw, going through a separate hole, contacting each of the legs.

A first guard screw 560 goes through a first guard screw hole 555. The first guard screw hole 555 is perpendicular to the first guard hole 553. The first guard screw hole 555 has an opening into the first guard hole 553. When the first guard screw 560 is oriented through the first guard screw hole 555 an end of the first guard screw 560 hits the first leg 752 of the wire guard 750 and the first leg 752 of the wire guard 750 is held in place from the friction of the contact of the end the first guard screw 560 hitting the first leg 752 of the wire guard 750. A second guard screw 561 goes through a second guard screw hole 556. The second guard screw hole 556 is perpendicular to the second guard hole 554. The second guard screw hole 556 has an opening into the second guard hole 554. When the second guard screw 561 is oriented through the second guard screw hole 556 an end of the second guard screw 561 hits the second leg 753 of the wire guard 750 and the second leg 753 of the wire guard 750 is held in place from the friction of the contact of the end the second guard screw 561 hitting the second leg 753 of the wire guard 750. Each of the first guard screws can be a set screw which is 8-32×⅛ inch.

An embodiment of the extension arm can have an accessory mounting plate base of an extension arm with a guard front face 575 and an accessory mounting plate base of an extension arm with a guard rear face 576. The first guard screw hole 555 goes through the extension arm can have accessory mounting plate base of an extension arm with a guard front face 575 and the second guard screw hole 556 goes through the accessory mounting plate base of an extension arm with a guard rear face 576. There can be an embodiment of an accessory mounting plate base of an extension arm with a guard left face 577 and an embodiment of an accessory mounting plate base of an extension arm with a guard right face 578. The guard holes 553, 554 have an opening on the accessory mounting plate base of an extension arm with a guard left face 577 and the accessory mounting plate base of an extension arm with a guard right face 578.

The wire guard 750 can be adjusted in the distance the legs are pushed into the guard holes. This will allow the wire guard 750 to accommodate different sized secondary accessories. The legs of the wire guard 750 can be shorter or longer lengths depending on the embodiments of the wire guard 750. It is possible the legs are different lengths within the same embodiment, but the legs are usually the same length in a particular embodiment.

An embodiment of the wire guard 750 can have measurements of: 1.96 inches from top to bottom, the length of the end of the one leg to the start of the first bend of the leg, such as the first bend of the first leg 756, can be 1.1 inches, and the blank piece of wire bent into the guard can be 7.225 inches.

Embodiments of the AOM are adjustable in multiple ways which improve the usability of the mount.

Figure 8:
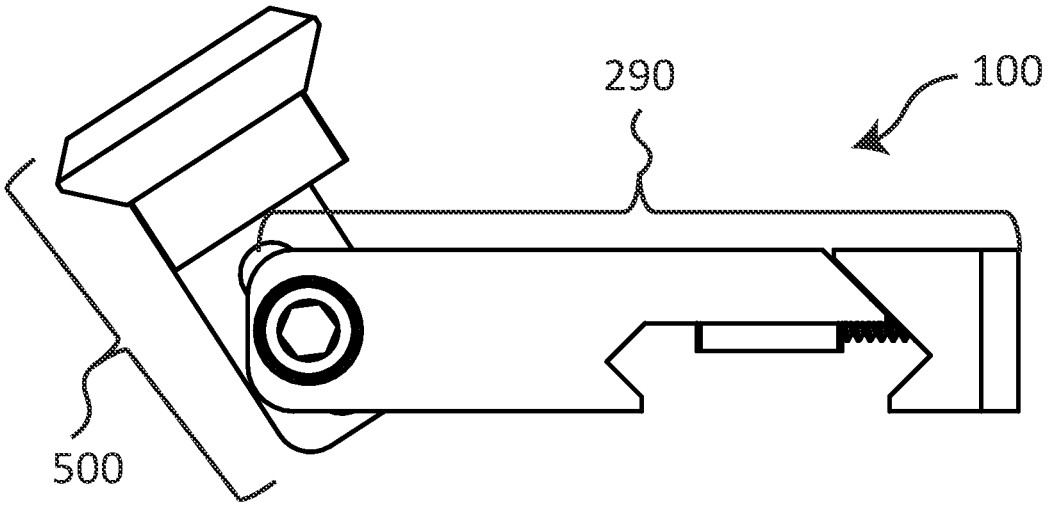
FIG. 8 is a rear elevational view of an embodiment of an AOM without a guard.
Figure 9:
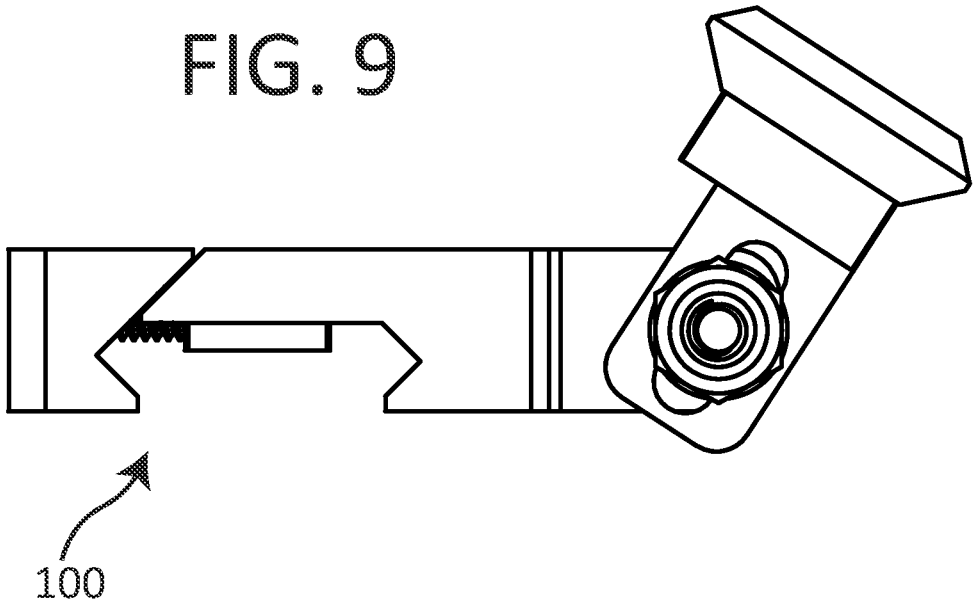
FIG. 9 is a front elevational view of an embodiment of an AOM without a guard.

The embodiments of an AOM without a guard and an AOM with a guard can be removably attached to either the left or the right side on the main accessory rail of the firearm. The ability to have an AOM without a guard and an AOM with a guard on either side of the main accessory rail of the firearm can be called an ambidextrous mount. An example of the AOM without a guard on either side of the main accessory rail of the firearm can be seen in FIG. 8 and FIG. 9, where if the AOM without a guard were attached to the firearm as viewed in the figures and the viewer was looking toward the opening of firearm barrel where the bullet exits 815, then the AOM without a guard would be on the left side of the main accessory rail in FIG. 8 and on the right side of the main accessory rail in FIG. 9. The same configuration would be possible for an AOM with a guard 750. Generally the front and rear of the AOM are described in this description with the AOM attached to the right side of main accessory rail and viewing the AOM by looking at the opening of firearm barrel where the bullet exits 815 and the AOM being to the right, or the right side of the main accessory rail, and the face of the AOM facing the viewer is the front face.

Figure 51:
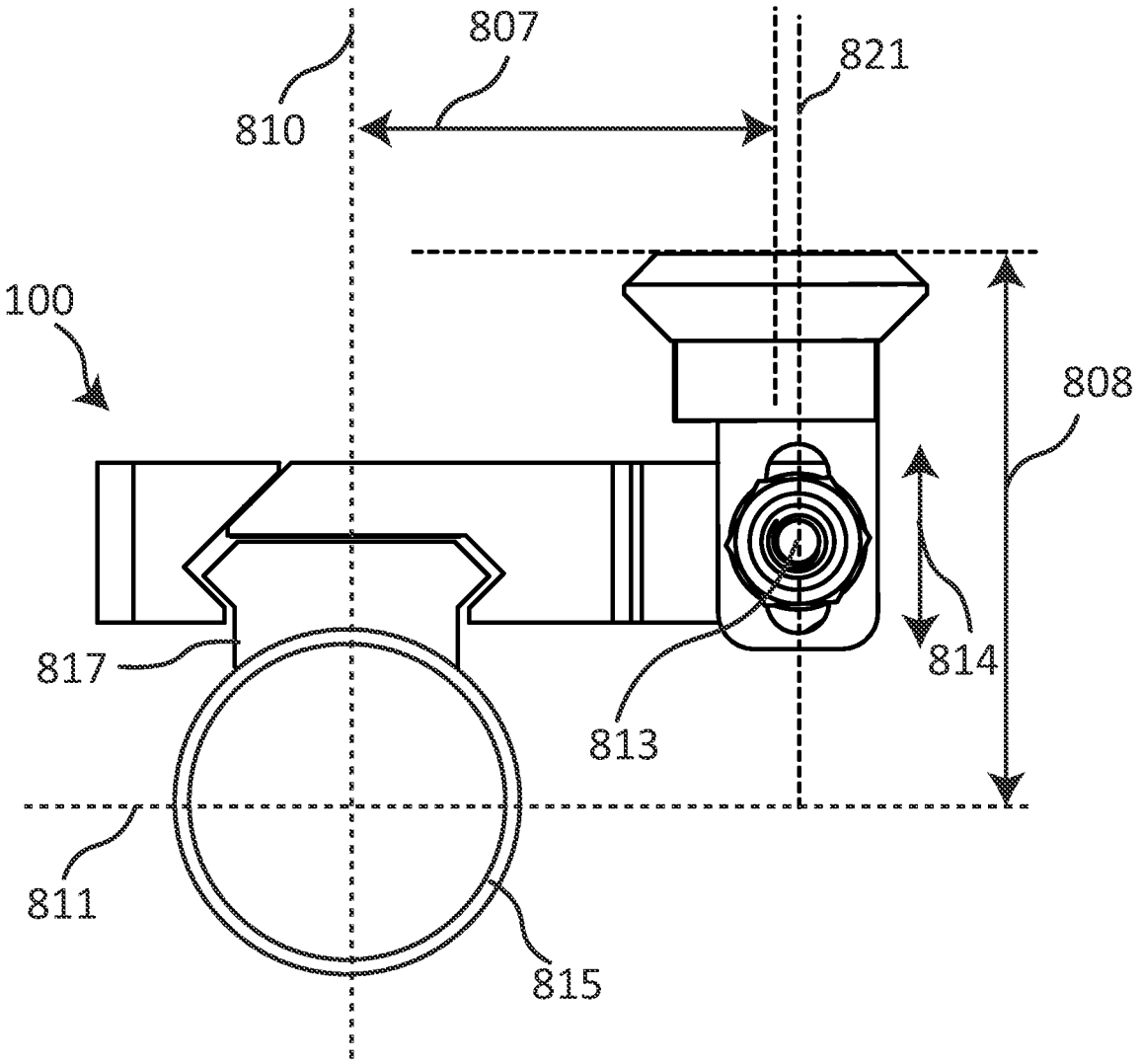
FIG. 51 is a front elevational view of the opening of a firearm barrel with a main accessory rail on top of the barrel where an embodiment of an AOM, without a guard, in a zero degree offset angle, is attached to the main accessory rail.
Figure 52:
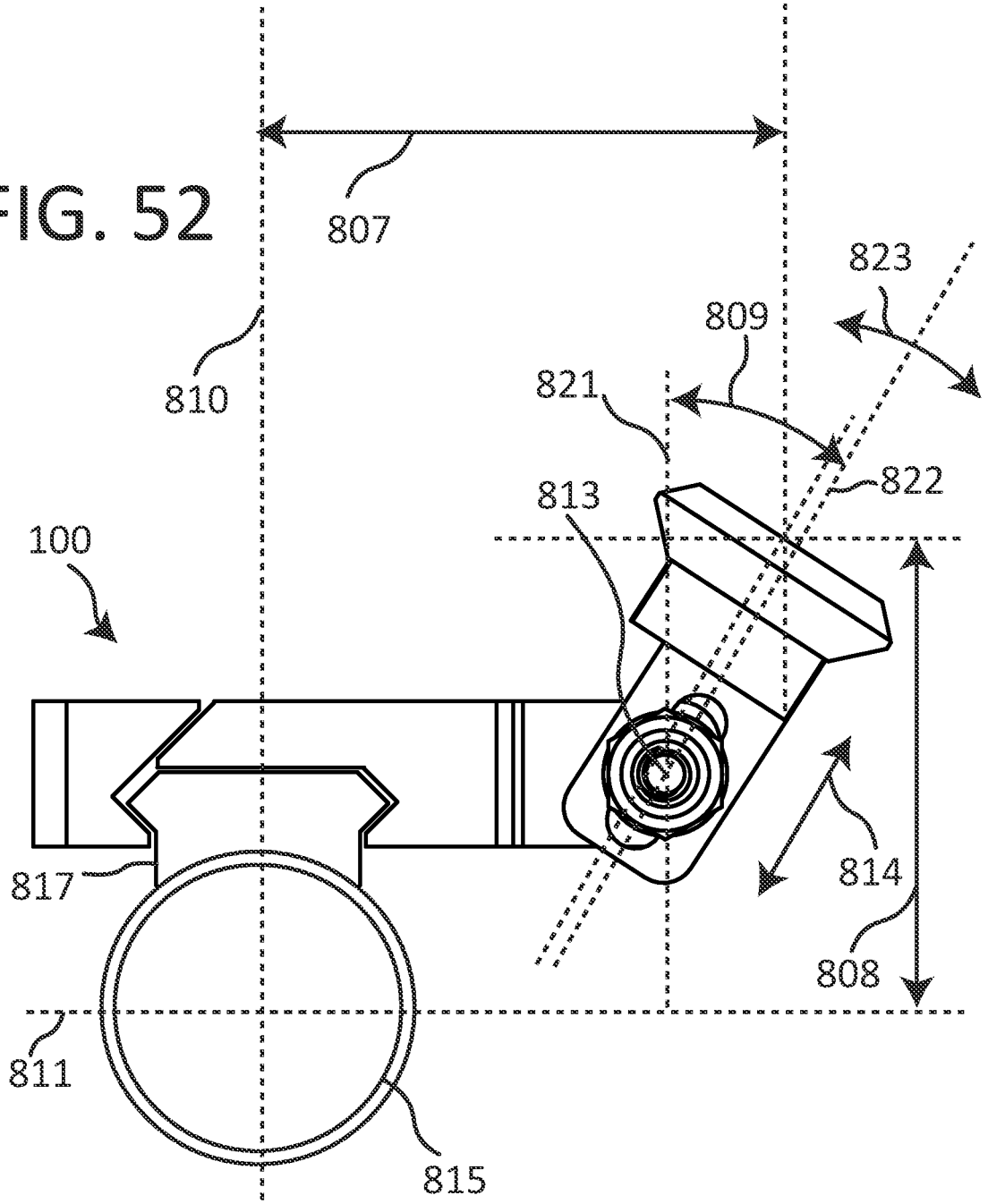
FIG. 52 is a front elevational view of the opening of a firearm barrel with a main accessory rail on top of the barrel where an embodiment of an AOM, without a guard, in an approximate 45 degree offset angle, is attached to the main accessory rail.

Another way embodiments are adjustable is the offset angle. The extension arm structure 500 can be rotated about a pivot axis 813. The adjustment can occur when the nylon lock nut 670 is loosed at the end of the pivot bolt 650. Then when the nylon lock nut 670 is retightened the extension arm structure 500 stays in place at the desired offset angle. The pivot axis 813 is in the center of pivot bolt 650. This adjustment can be done with other cinch pivot structures 640. Also the pivot axis 813 is in the center of the pivot bolt 650 or asymmetric end lever pivot bolt 691 for variations of the cinch pivot structures 640. The extension arm structure 500 can be vertical as in FIG. 51. When the extension arm structure 500 is vertical the offset angle of the accessory mounting plate 809 is zero degrees as compared to the vertical plane of the accessory mounting plate parallel to the vertical plane at the center of the firearm barrel 821. When the extension arm structure 500 is not vertical then the offset angle of the accessory mounting plate 809 is not zero degrees and there is a rotated vertical plane of the accessory mounting plate 822. The offset angle of the accessory mounting plate 809 is measured from the vertical plane of the accessory mounting plate parallel to the vertical plane at the center of the firearm barrel 821 to the rotated vertical plane of the accessory mounting plate 822. When viewing the front of the AOM, and therefore the opening of firearm barrel where the bullet exits 815, when the AOM is to the right side of the firearm, the degrees of offset can be defined by rotation clockwise of the extension arm structure 500 are considered positive degrees of offset until a half turn is reached. If the extension arm structure 500 is rotated counter clockwise the degrees of offset are considered negative until a half turn is reached. A one eighth rotation clockwise turn is a 45 degree offset angle of the accessory mounting plate 809, a quarter rotation clockwise turn is a 90 degree offset angle of the accessory mounting plate 809, and three eighths clockwise turn is a 135 degree offset angle of the accessory mounting 809. A one eighth rotation counter clockwise turn is a negative 45 degree offset angle of the accessory mounting plate 809, a quarter rotation counter clockwise turn is a negative 90 degree offset angle of the accessory mounting plate 809, and three eighths counter clockwise turn is a negative 135 degree offset angle of the accessory mounting 809. A half turn is considered a positive or negative 180 degree offset angle of the accessory mounting plate 809. If the AOM is mounted on the other side of the main accessory rail, the left side, then the positive and negative offset angles are reversed, meaning if the extension arm structure 500 is rotated counter clockwise until a half turn those angles are considered positive and if the extension are structure 500 is rotated clockwise until a half turn those angles are considered negative.

Another way embodiments are adjustable is the offset distance of the center of the accessory mounting plate 807. The accessory mounting plate is attached to the end of the extension arm structure 500. The offset distance of the center of the accessory mounting plate 807 is measured from the vertical plane at the center of the firearm barrel 810 to the center of the accessory mounting plate to give the offset distance of the center of the accessory mounting plate 807. The center of the accessory mounting plate is at the surface of the accessory mounting plate, which is not in contact with the extension arm, at the center of the distance from the right edge to the left edge of the accessory mounting plate when viewed in a front view, when viewing the front of the AOM, and therefore the opening of firearm barrel where the bullet exits 815. The offset distance of the center of the accessory mounting plate 807 adjustment can occur when the nylon lock nut 670 is loosed on at the end of the pivot bolt 650. Then when the nylon lock nut 670 is retightened the extension arm structure 500 stays in place at the desired offset distance. This adjustment can occur with other cinch pivot structures 640. The offset distance of center of accessory mounting plate 807 can change up to about 0.5 inches.

Another way embodiments are adjustable is the distance of the center of the accessory mounting plate from the horizontal plane at the center of the firearm barrel 808. The accessory mounting plate is attached to the end of the extension arm structure 500. The distance of the center of the accessory mounting plate from the horizontal plane at the center of the firearm barrel 808 is measured from the horizontal plane at the center of the firearm barrel 811 to the center of the accessory mounting plate to give the distance of the center of the accessory mounting plate from the horizontal plane at the center of the firearm barrel 808. The accessory mounting plate is attached to the end of the extension arm structure 500. The center of the accessory mounting plate is at the surface of the accessory mounting plate, which is not in contact with the extension arm, at the center of the distance from the right edge to the left edge of the accessory mounting plate when viewed in a front view, when viewing the front of the AOM, and therefore the opening of firearm barrel where the bullet exits 815. The distance of the center of the accessory mounting plate from the horizontal plane at the center of the firearm barrel 808 adjustment can occur when the nylon lock nut 670 is loosed at the end of the pivot bolt 650. Then when the nylon lock nut 670 is retightened the extension arm structure 500 stays in place at the desired distance from the horizontal plane at the center of the firearm barrel. This adjustment can occur with other cinch pivot structures 640.

If the extension arm structure does not have a separate accessory mounting plate the measurements of offset angle is the same as with a separate accessory mounting plate and the measurements of the distance from the barrel are measured from the center, from left to right, of where the accessory is attached.

The adjustments to the extension arm structure 500 can be adjusted in different elements at the same time. The extension arm without a guard 501 or an extension arm with a guard 550 both have an elongated slot hole. The elongated slot hole allows for different types of adjustments which are unique to the AOM embodiments described. The elongated slot hole allows for rotation movement of the extension arm structure 823. Also the elongated slot hole allows for in and out movement of extension arm structure in and out from barrel of firearm 814. The elongated slot hole allows the extension arm structure from one position to another position after loosening and tightening the nylon lock nut 670 or a similar adjustment with other cinch pivot structures 640.

The embodiments described in this disclosure allows for rotation and in and out movement. So multiple combinations of movement can happen between one position of the extension arm structure to another position of the extension arm structure which are: there is in and out movement but no rotation movement; there is no in and out movement but rotation movement; and there is both in and out movement and rotation movement. If there is in and out movement but no rotation movement, and if the extension arm structure is at zero or 180 degrees of offset then there will be movement with a change in the distance of the center of the accessory mounting plate from the horizontal plane at center of the firearm barrel 808 and no change in the offset distance of the center of the accessory mounting plate 807. If there is in and out movement but no rotation movement, and if the extension arm structure is at 90 or −90 degrees of offset then there will be movement with a change in offset distance of the center of the accessory mounting plate 807 and no change in the distance of the center of the accessory mounting plate from the horizontal plane at center of the firearm barrel 808.

The elongated slot hole allows for different positions which have the same offset angle of the accessory mounting plate 809 but a different distance of the center of the accessory mounting plate from the horizontal plane at center of the firearm barrel 808 and different offset distance of the center of the accessory mounting plate 807, so in other words there was a fixed position and then another fixed position after in and out movement of the extension arm structure 500 in and out from barrel of firearm where the offset angle was any other degree other than 0, 90, 180, or −90 degrees.

The ability to keep the same offset angle and then change the distance of the accessory mounting plate from the barrel of the firearm, left and right (offset distance of the center of the accessory mounting plate 807) or up or down (distance of the center of the accessory mounting plate from horizontal plane at the center of the firearm barrel 808), is a unique quality of the embodiments described, as compared to other prior art. Where other prior art allows for a rotation movement but do not have in and out movement. The embodiments in this disclosure, with an elongated slot hole, allows the user to find the optimal offset angle and then change the distances from the firearm barrel, when fine tuning the best position for their secondary accessory.

Figure 24:
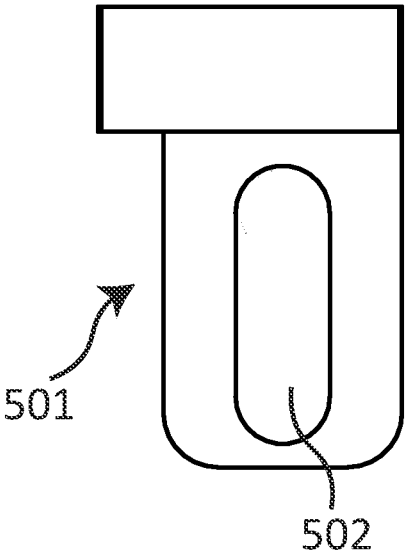
FIG. 24 is a front elevational view of an embodiment of an extension arm without a guard.
Figure 25:
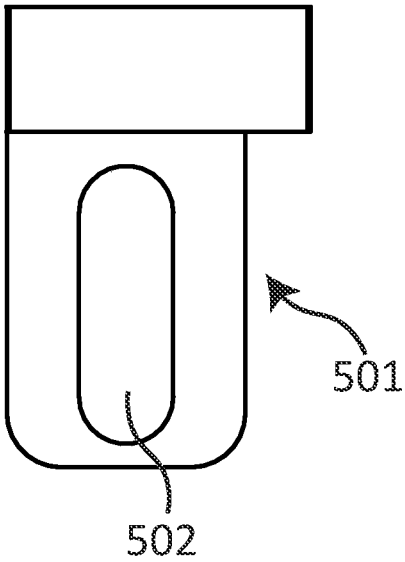
FIG. 25 is a rear elevational view of an embodiment of an extension arm without a guard.
Figure 26:
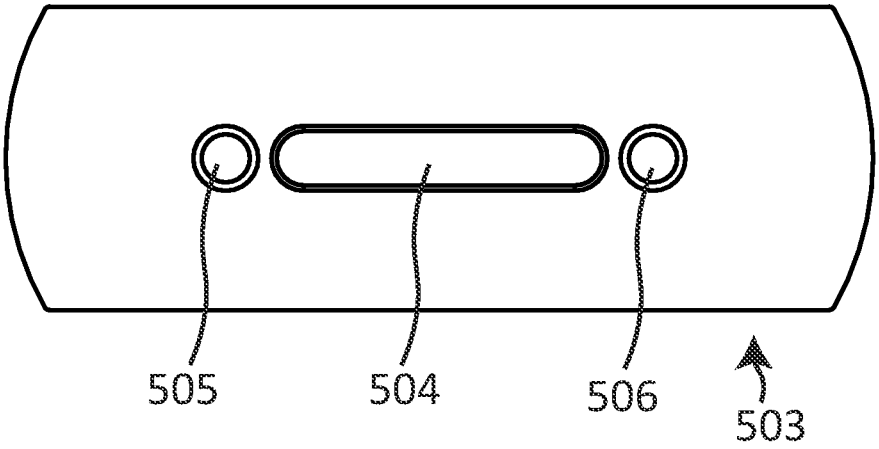
FIG. 26 is a top plan view of an embodiment of an extension arm without a guard.
Figure 27:
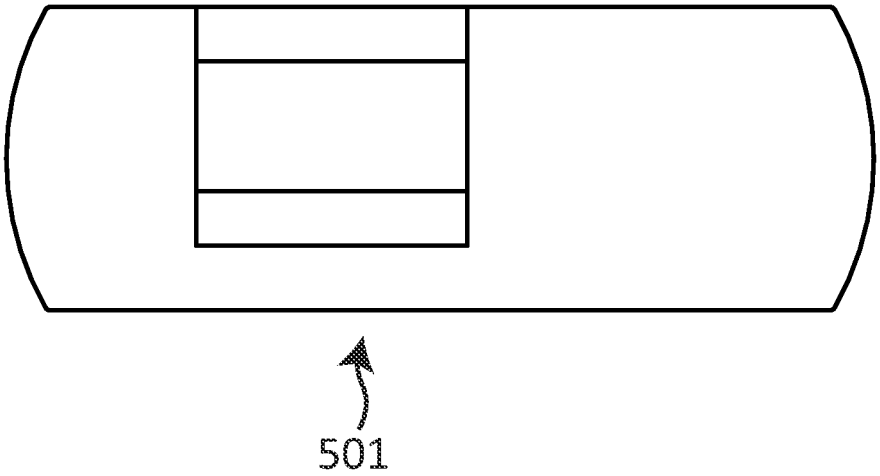
FIG. 27 is a bottom plan view of an embodiment of an extension arm without a guard.
Figure 28:
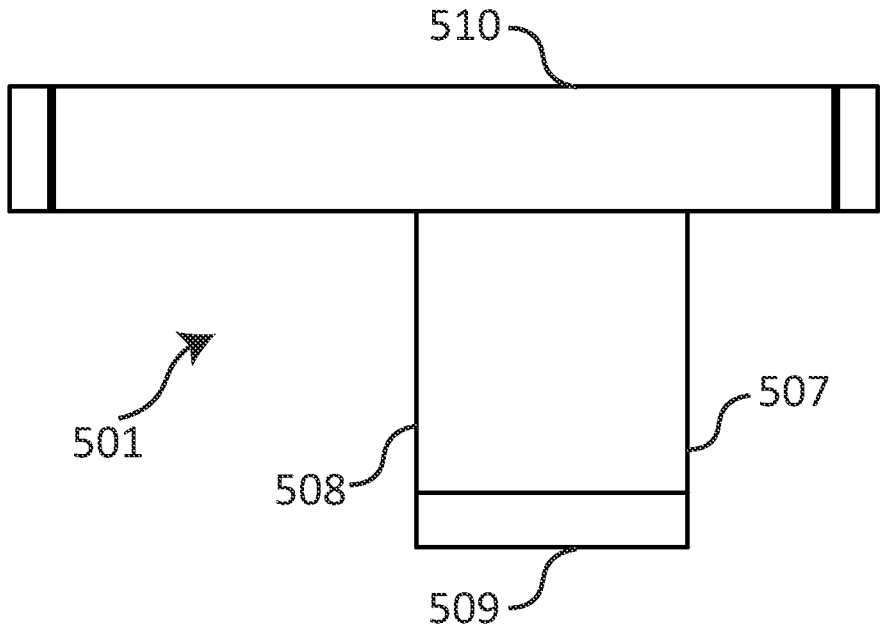
FIG. 28 is a left elevational view of an embodiment of an extension arm without a guard.

The embodiments of the extension arm without a guard 501 and an extension arm with a guard 550 are asymmetrical related to the accessory mounting plate base and therefore the accessory mounting plate. When viewing the extension arm without a guard 501 in a front view as in FIG. 24 and an extension arm with a guard 550 in a front view as in FIG. 37A the accessory mounting is not centered in the extension arm, with a different profile on the right side which is flat and the left side which is bumped out. The difference in the sides allows for the extension arm structure 500 to be flipped around from the first front and rear definition to allow for the extension arm structure to fit more snuggly up against another object such as a primary accessory on the main accessory rail of the firearm. Sometimes the flat side will fit more snuggly. Sometimes the bumped out side will fit more snuggly. A more snug fit occurs when the extension arm structure is closer to the vertical plane at the center of the firearm barrel 810. The closer the extension arm structure 500 is to the vertical plane at the center of the firearm barrel 810 the greater the ability of the user to switch between using the primary and secondary accessory. When the line of sight for the user of the primary accessory is closer in distance to the secondary accessory the easier the switch for the user. The primary accessory is normally centered in the vertical plane at the center of the firearm barrel 810. Then when the user wants to use the secondary accessory, the user can rotate the whole firearm so the second accessory is twisted into the line of sight of the user. The closer in distance of the primary accessory to the secondary accessory the shorter the distance the user has to twist the firearm and the easier it is for the user to use the secondary accessory, which can also be called aiming with the secondary accessory or lining up the secondary accessory.

Figure 29:
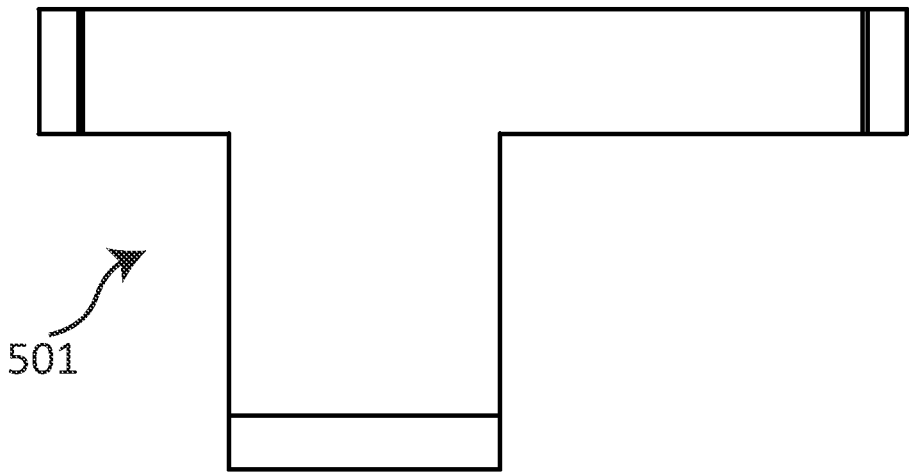
FIG. 29 is a right elevational view of an embodiment of an extension arm without a guard.
Figure 30:
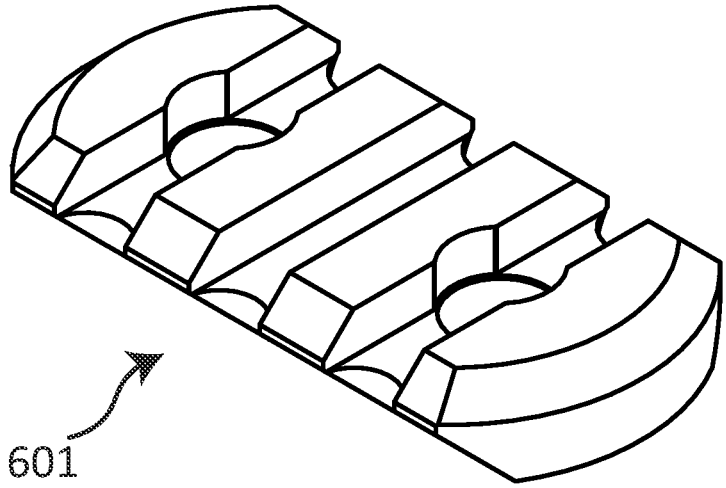
FIG. 30 is a top perspective view of an embodiment of a three slot Picatinny rail accessory mounting plate.
Figure 31:
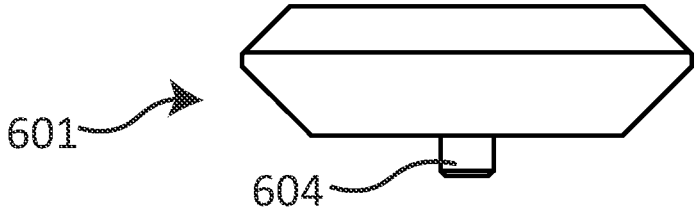
FIG. 31 is a front or rear elevational view of an embodiment of a three slot Picatinny rail accessory mounting plate.
Figure 32:
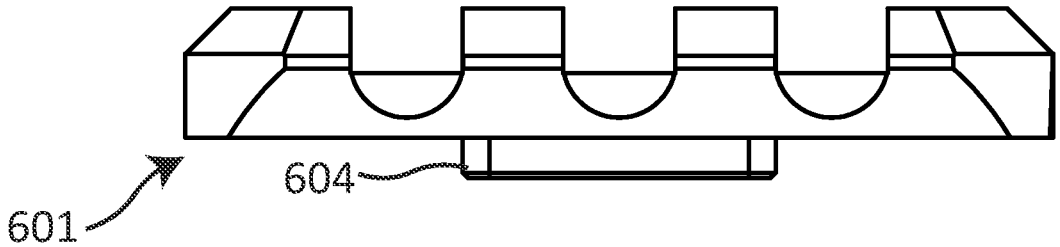
FIG. 32 is a left or right elevational view of an embodiment of a three slot Picatinny rail accessory mounting plate.
Figure 33:
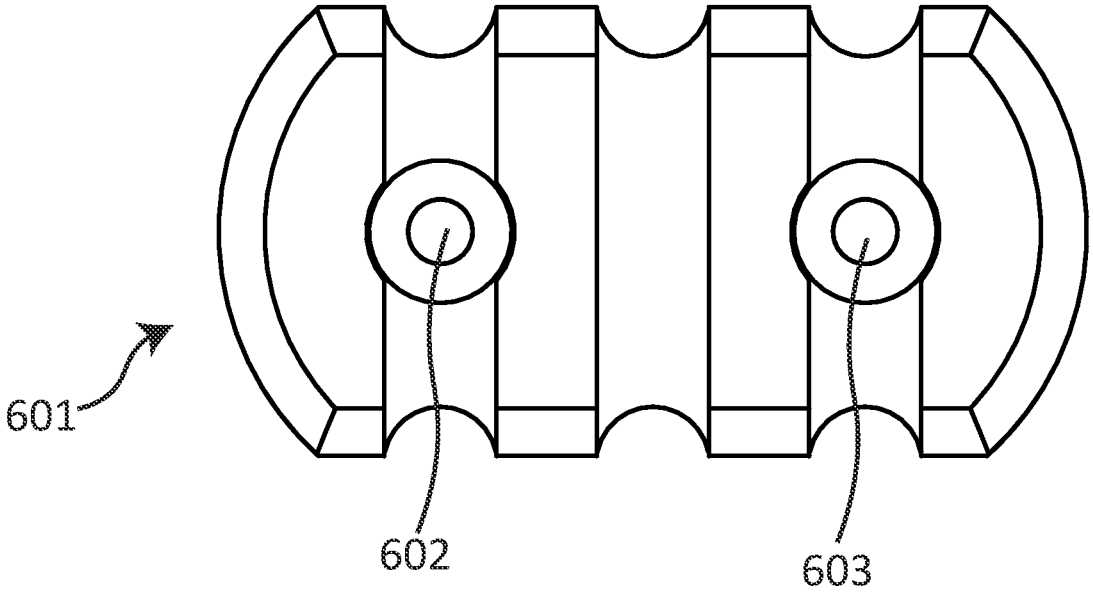
FIG. 33 is a top plan view of an embodiment of a three slot Picatinny rail accessory mounting plate.
Figure 34:
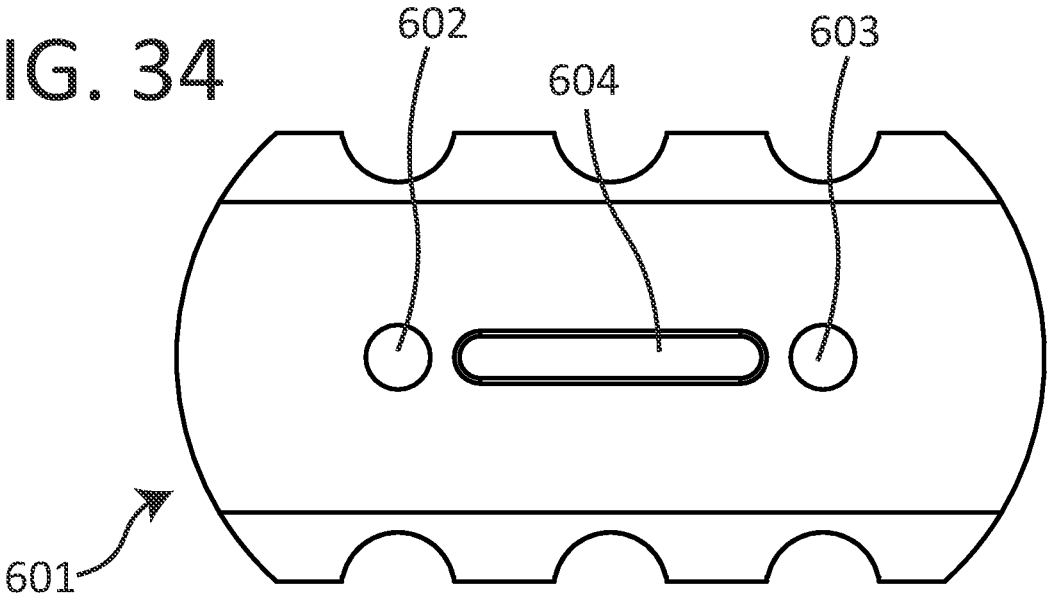
FIG. 34 is a bottom plan view of an embodiment of a three slot Picatinny rail accessory mounting plate.
Figure 35A:
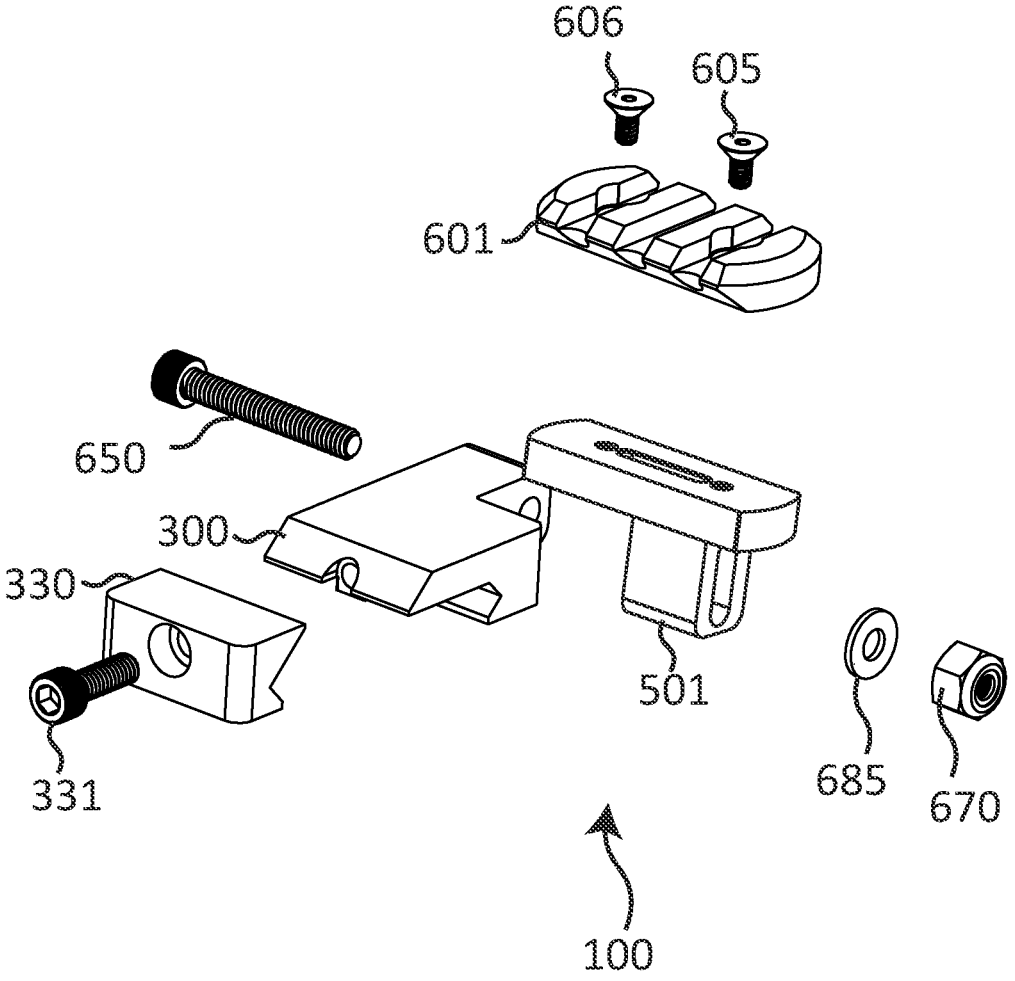
FIG. 35A is an exploded top perspective view of an AOM without a guard.
Figure 35B:
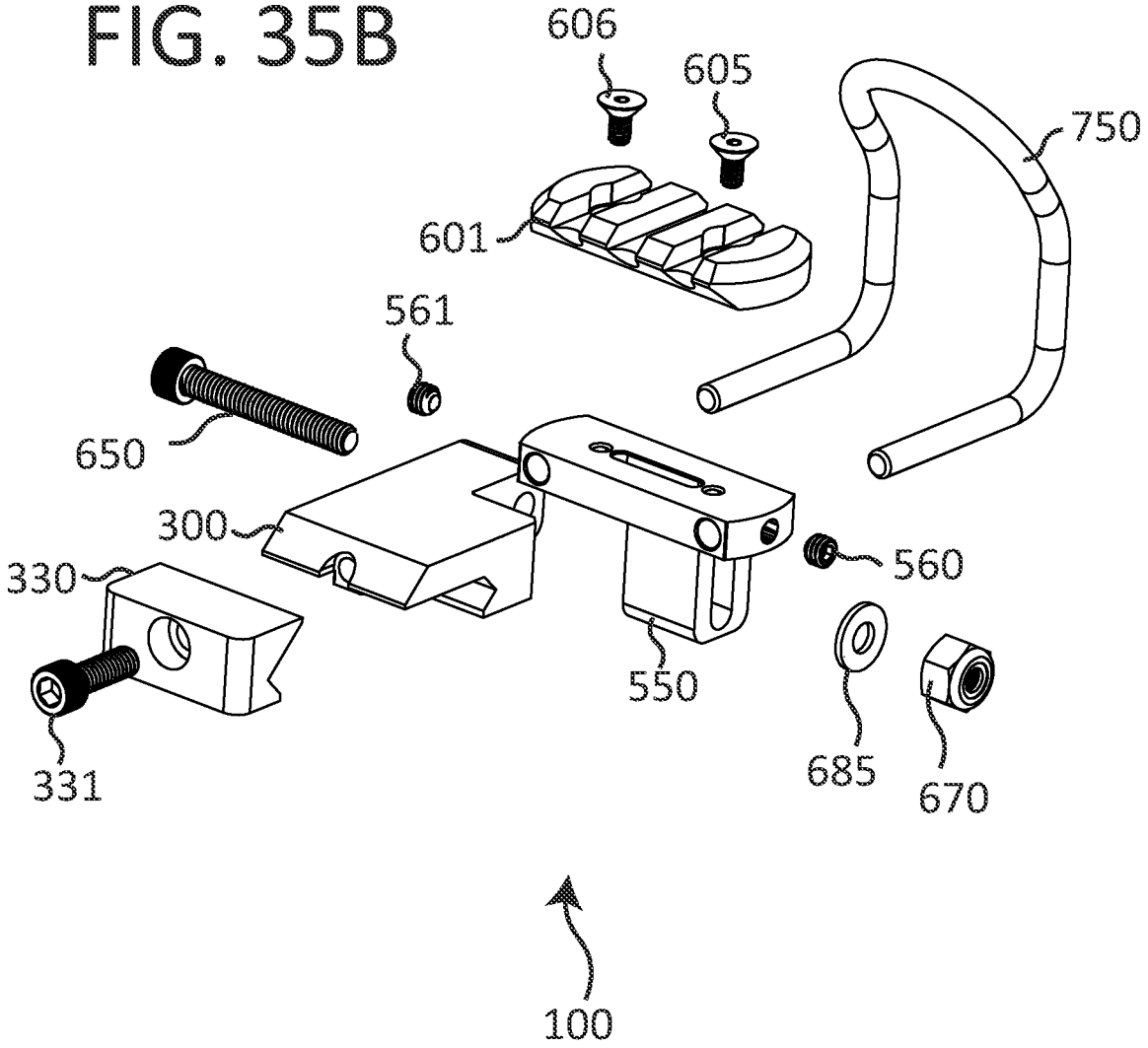
FIG. 35B is an exploded top perspective view of an AOM with a guard.
Figure 36:
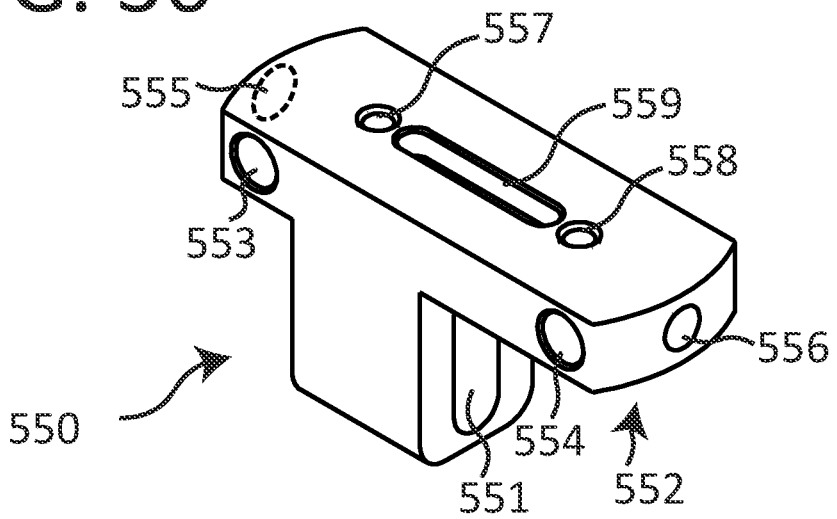
FIG. 36 is a top perspective view of an embodiment of an extension arm configured for a guard to removably attach to the extension arm.
Figure 37A:
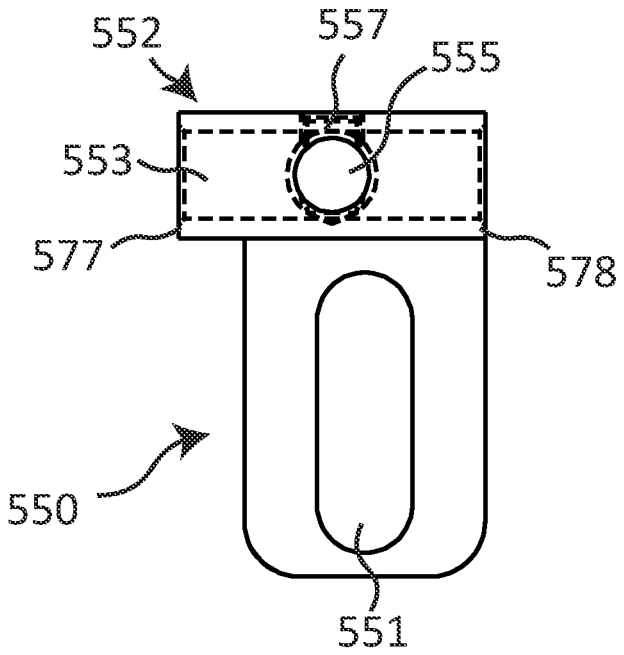
FIG. 37A is a front elevational view of an embodiment of an extension arm configured for a guard to removably attach to the extension arm.
Figure 37B:
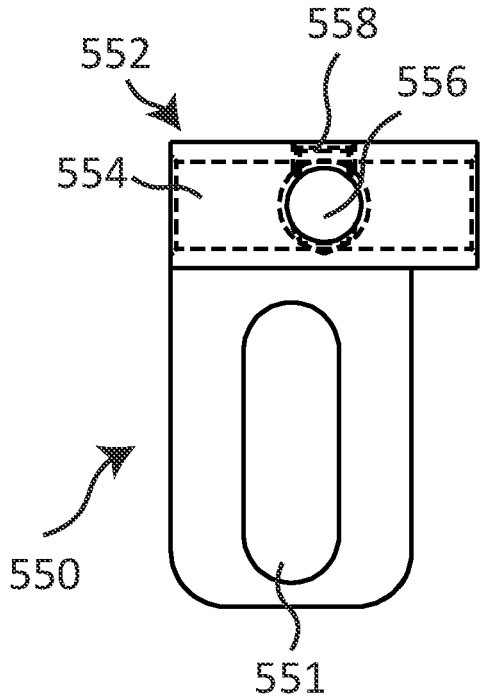
FIG. 37B is a rear elevational view of an embodiment of an extension arm configured for a guard to removably attach to the extension arm.
Figure 38:
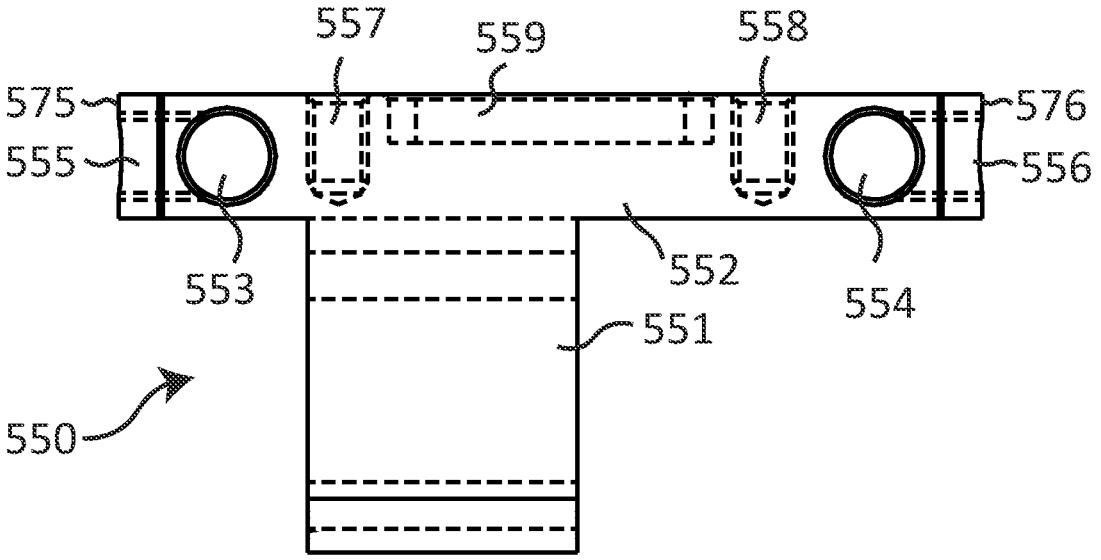
FIG. 38 is a right elevational view of an embodiment of an extension arm configured for a guard to removably attach to the extension arm.
Figure 39:
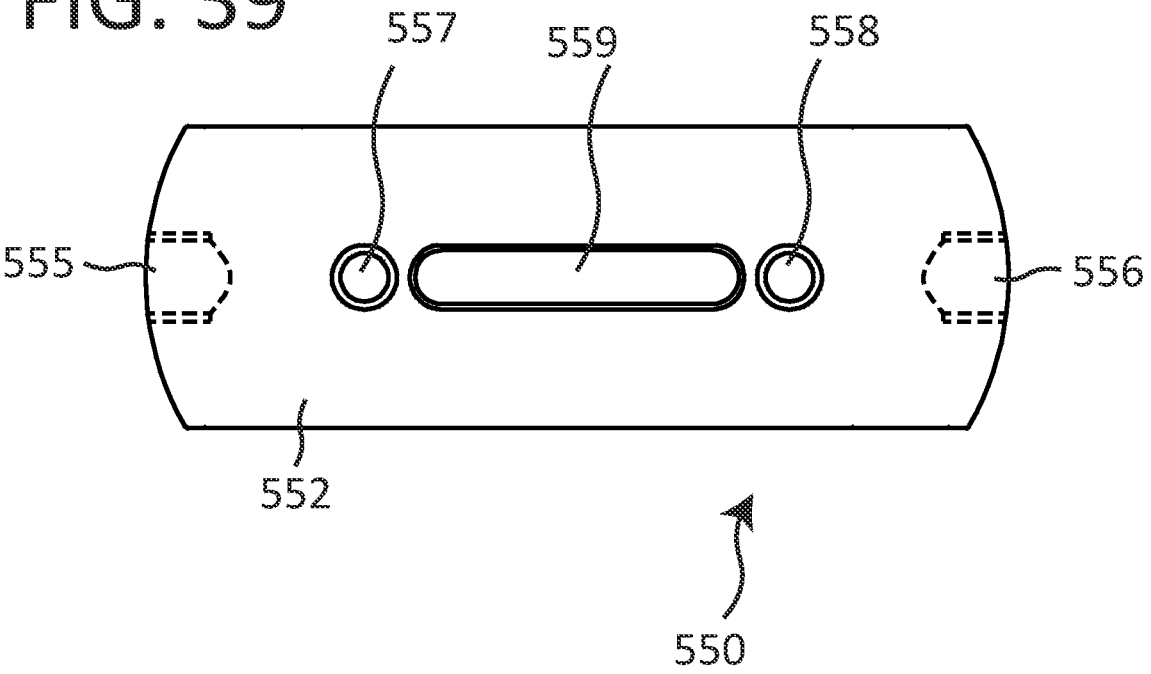
FIG. 39 is a top plan view of an embodiment of an extension arm configured for a guard to removably attach to the extension arm.
Figure 40:
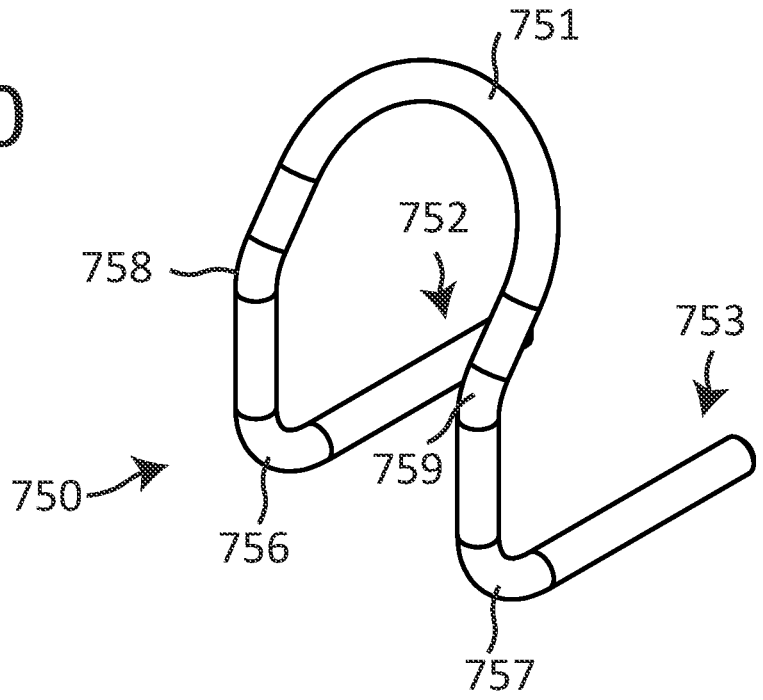
FIG. 40 is a top perspective view of an embodiment of a guard.
Figure 41:
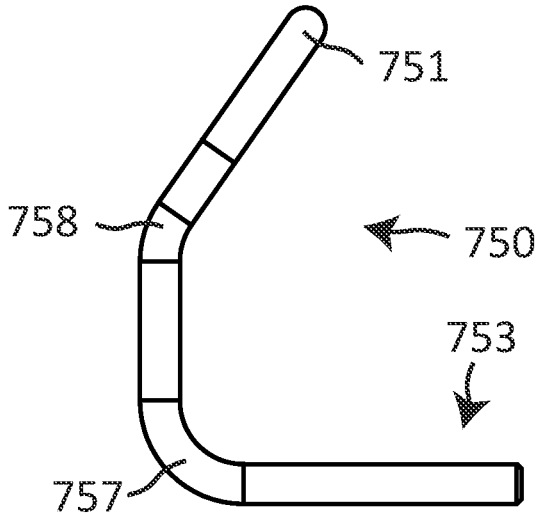
FIG. 41 is a rear elevational view of an embodiment of a guard.
Figure 42:
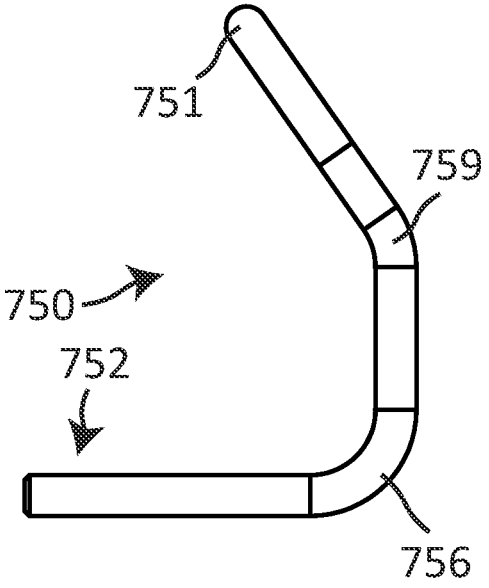
FIG. 42 is a front elevational view of an embodiment of a guard.
Figure 43:
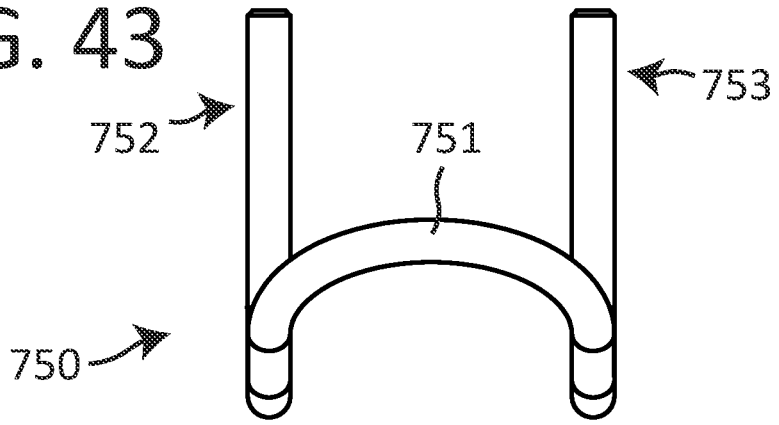
FIG. 43 is a top plan view of an embodiment of a guard.
Figure 44:
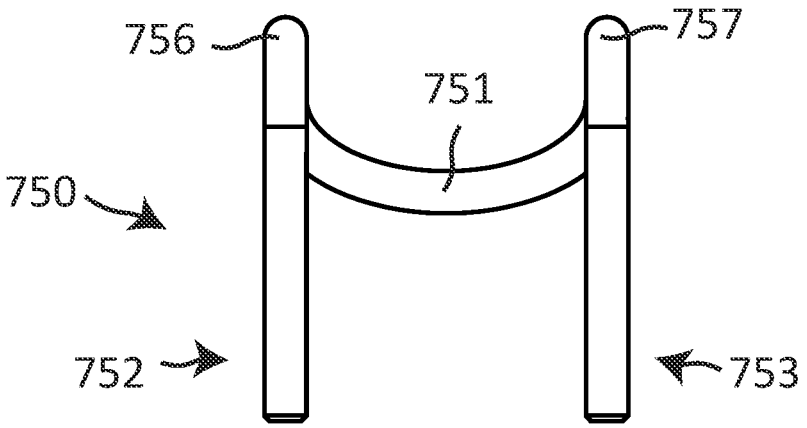
FIG. 44 is a bottom plan view of an embodiment of a guard.
Figure 45:
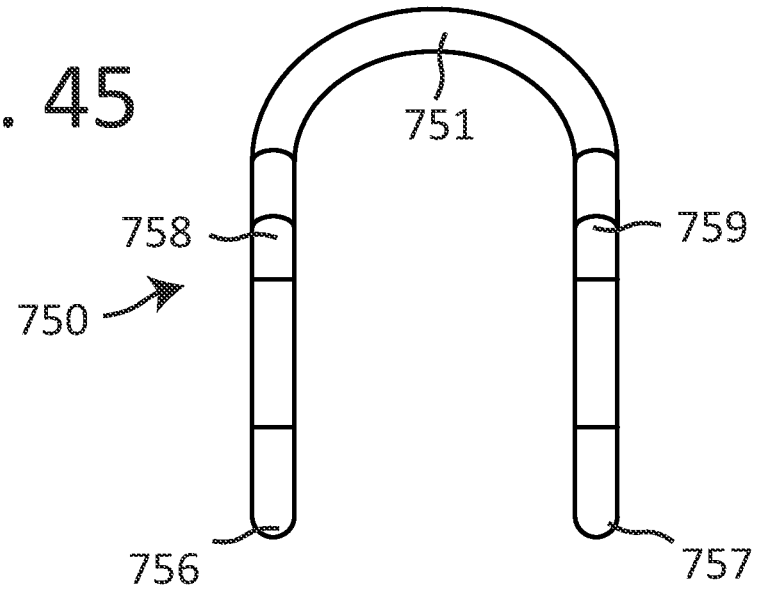
FIG. 45 is a right elevational view of an embodiment of a guard.
Figure 46:
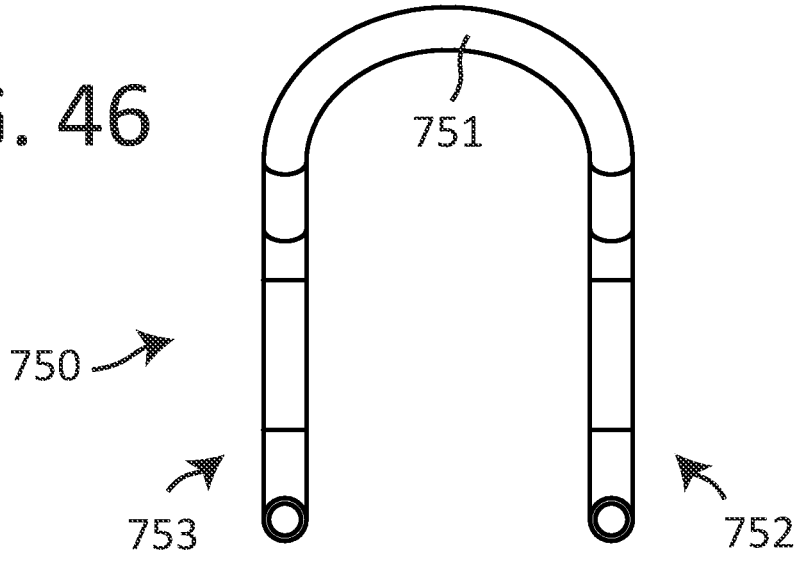
FIG. 46 is a left elevational view of an embodiment of a guard.
Figure 47A:
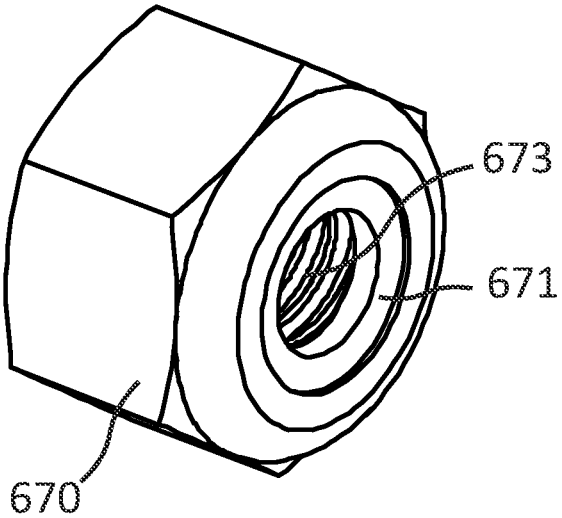
FIG. 47A is a top perspective view of an embodiment of a nylon insert lock nut.
Figure 47B:
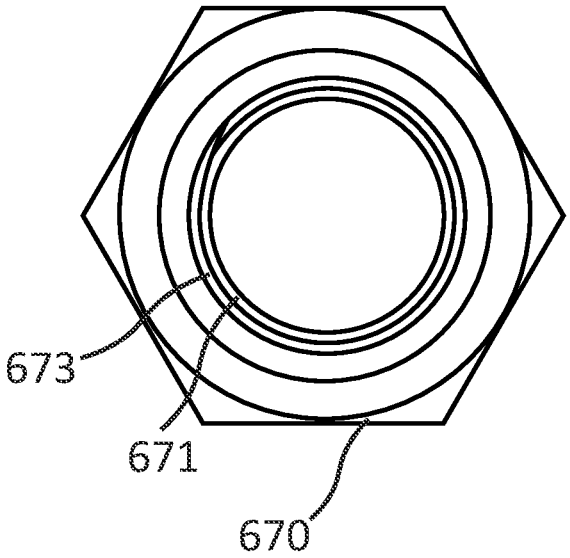
FIG. 47B is a rear elevational view of an embodiment of a nylon insert lock nut.
Figure 47C:
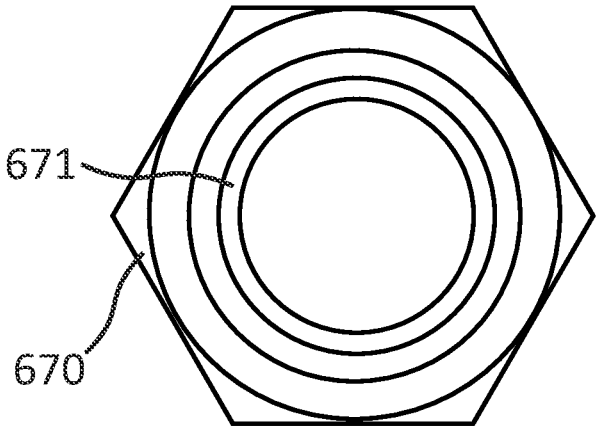
FIG. 47C is a front elevational view of an embodiment of a nylon insert lock nut.
Figure 48:
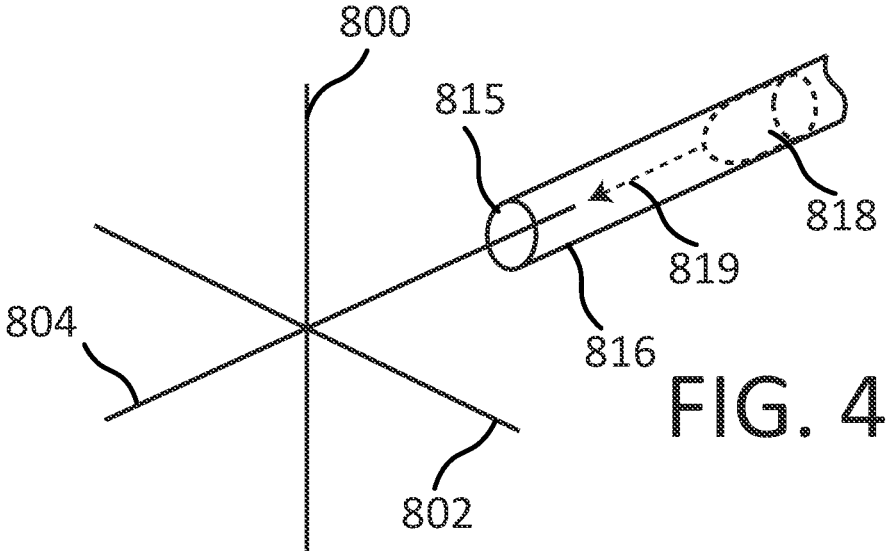
FIG. 48 is a top perspective view of the front portion of a firearm barrel with axes defining portions of the barrel and therefore other elements of the firearm.
Figure 49:
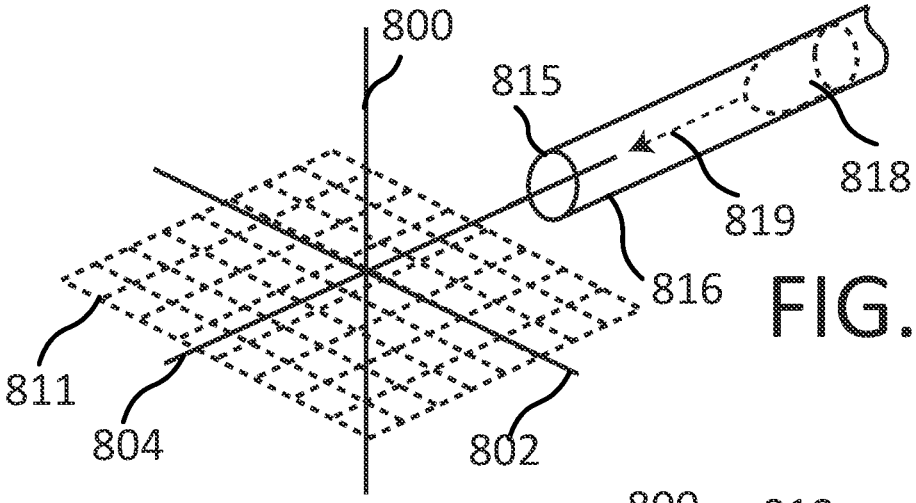
FIG. 49 is a top perspective view of the front portion of a firearm barrel with the horizontal plane of the firearm barrel represented.
Figure 50:
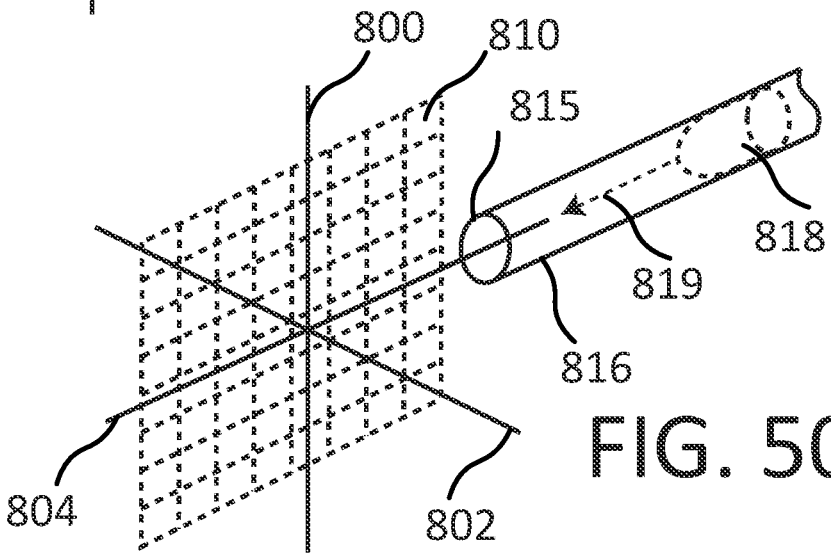
FIG. 50 is a top perspective view of the front portion of a firearm barrel with the vertical plane of the firearm barrel represented.
Figure 54:
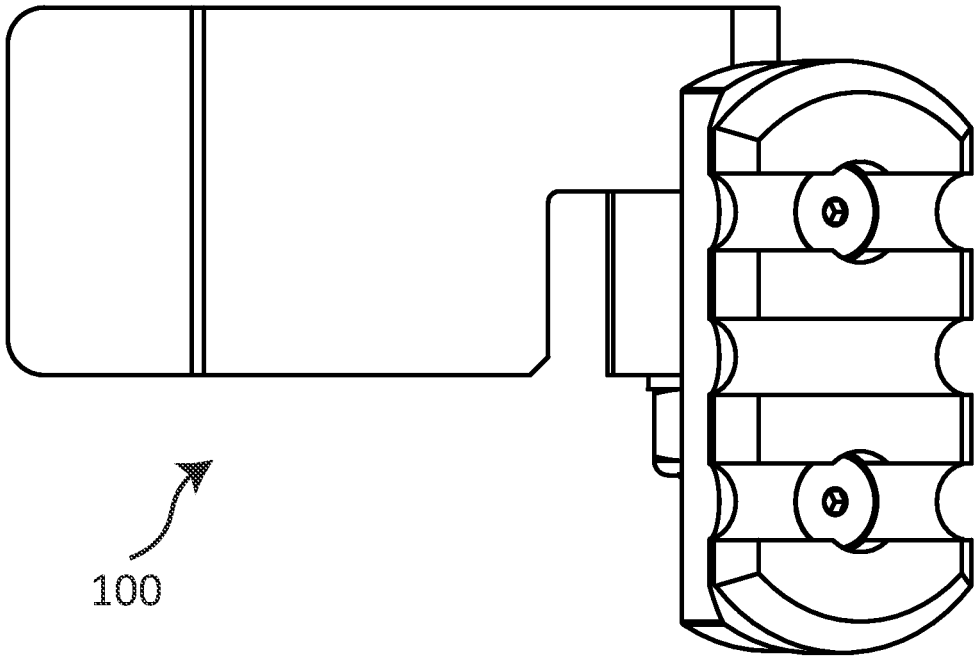
FIG. 54 is a top plan view of an embodiment of an AOM without a guard where the extension arm structure is flipped around from the traditional arrangement of the AOM without a guard.
Figure 55A:
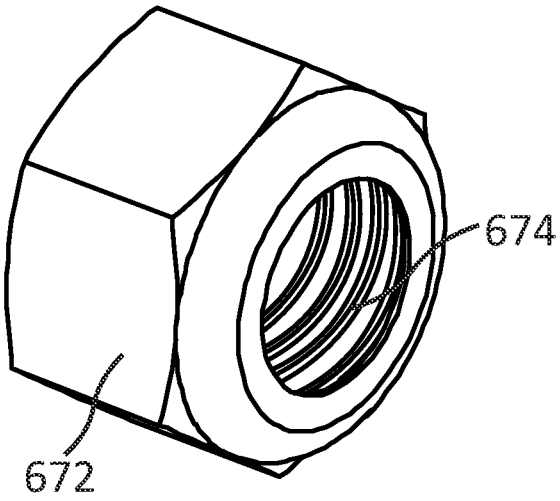
FIG. 55A is a top perspective view of an embodiment of a nut.
Figure 55B:
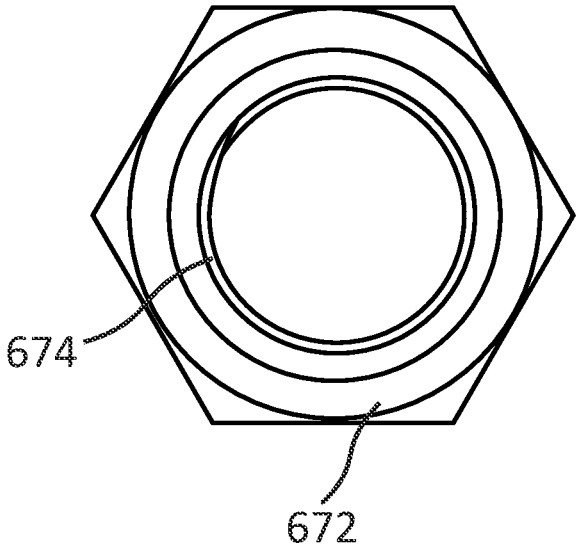
FIG. 55B is a front or rear elevational view of an embodiment of a nut.
Figure 56:
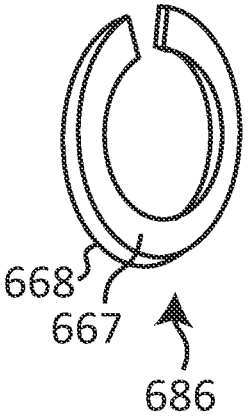
FIG. 56 is a front perspective view of an embodiment of a spring washer.
Figure 57:
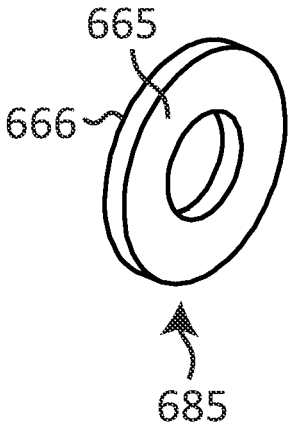
FIG. 57 is a front perspective view of an embodiment of a washer.
Figure 58:
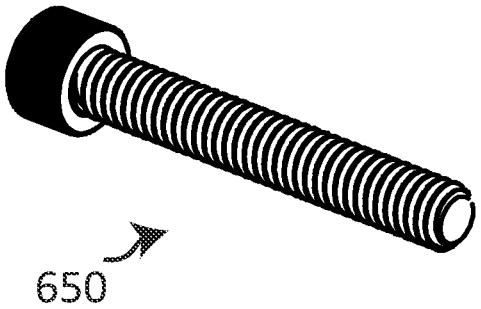
FIG. 58 is a top front perspective view of an embodiment of a pivot bolt.
Figure 59:
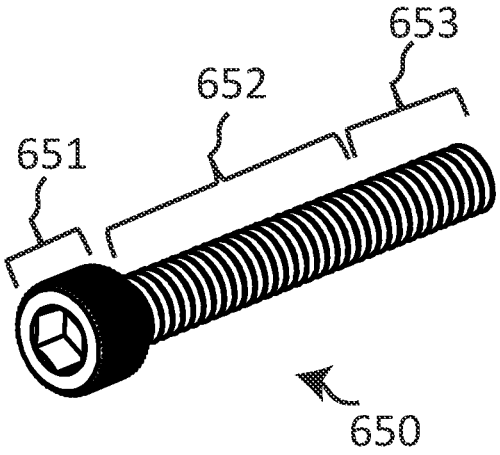
FIG. 59 is a top rear perspective view of an embodiment of a pivot bolt.
Figure 60:
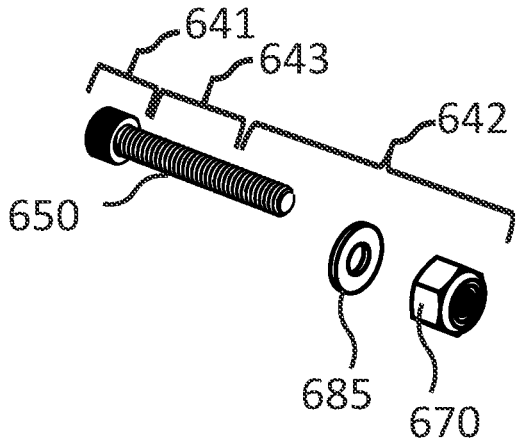
FIG. 60 is an exploded view of an embodiment of a cinch pivot structure of a pivot bolt, washer, and nylon insert lock nut.
Figure 61:
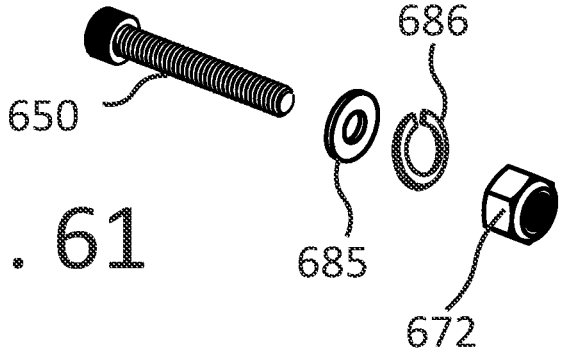
FIG. 61 is an exploded view of an embodiment of a cinch pivot structure of a pivot bolt, spring washer, a washer, and a nut.
Figure 62:
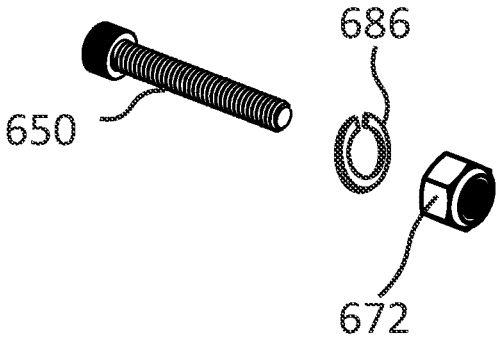
FIG. 62 is an exploded view of an embodiment of a cinch pivot structure of a pivot bolt, a spring washer, and a nut.
Figure 63A:
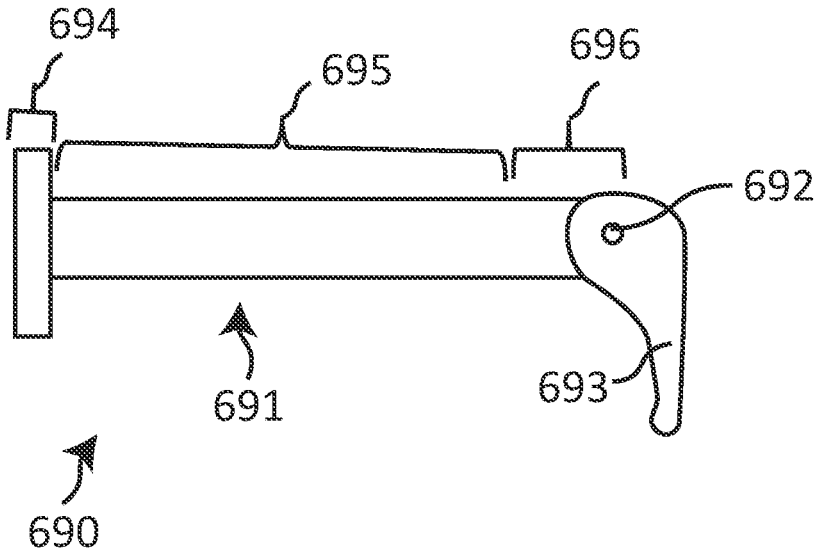
FIG. 63A is a top plan view of asymmetric end lever bolt structure in a tightened position.
Figure 63B:
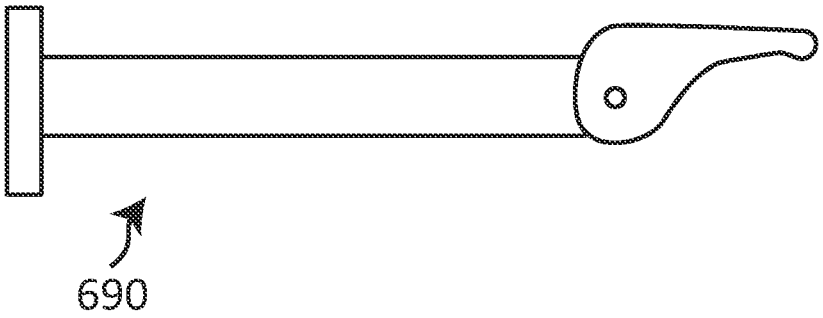
FIG. 63B is a top plan view of asymmetric end lever bolt structure in a loosened position.
Figure 64:
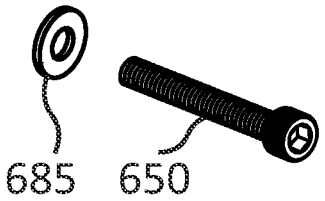
FIG. 64 is an exploded view of an embodiment of a cinch pivot structure of a pivot bolt and a washer.
Figure 65:
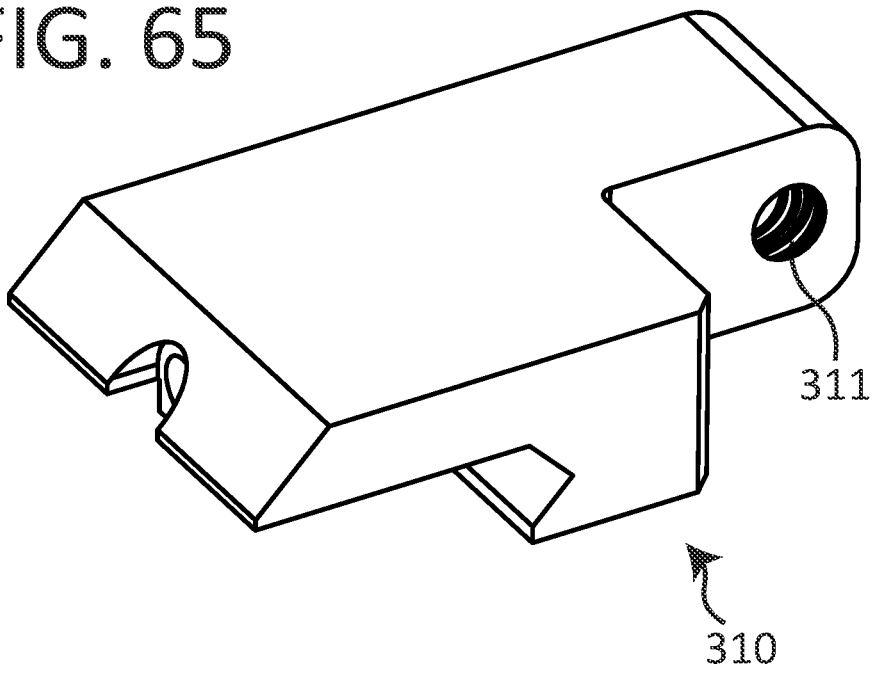
FIG. 65 is a top front perspective view of an embodiment of a base piece with threaded pivot attachment.
Figure 66:
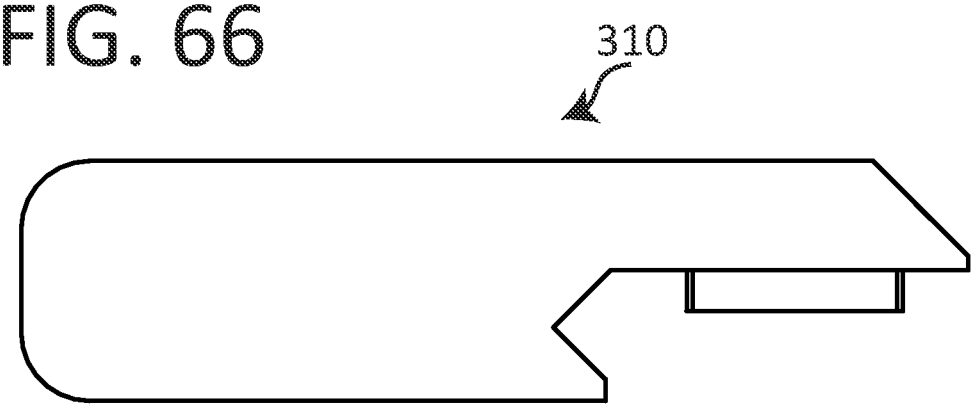
FIG. 66 is a rear plan view of an embodiment of a base piece with threaded pivot attachment.
Figure 67:
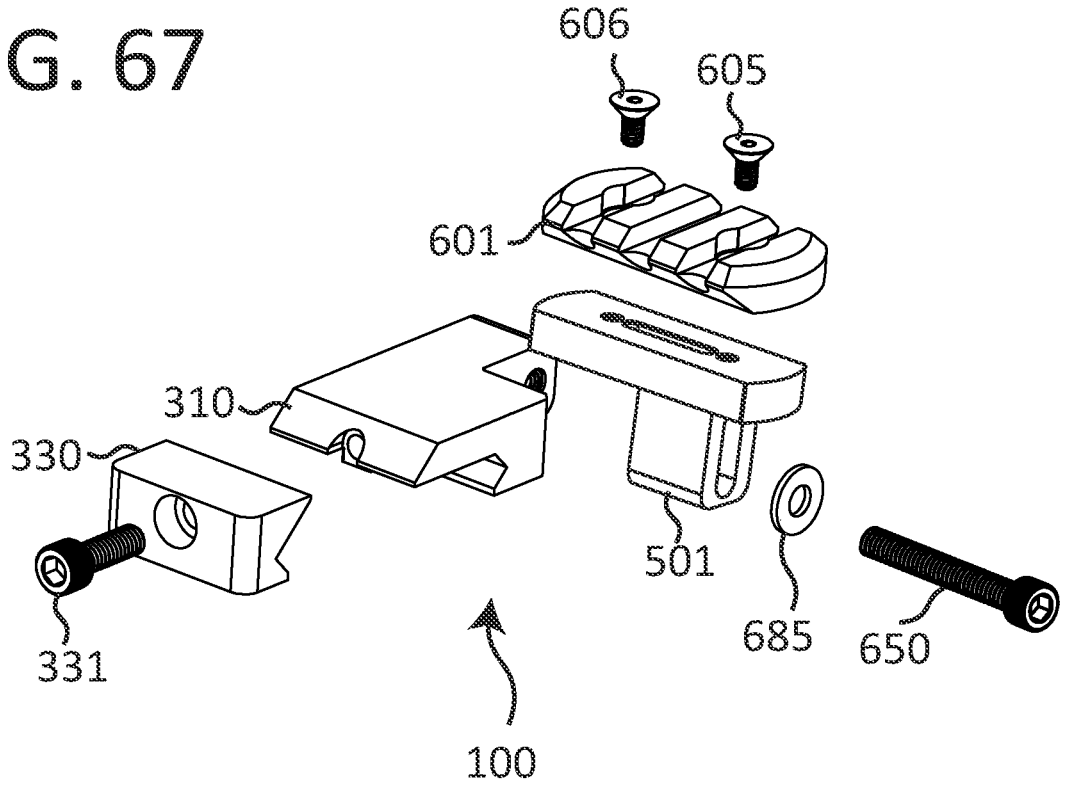
FIG. 67 is an exploded view of an embodiment of an AOM without a guard with a threaded attachment base piece.

In another aspect, the embodiments of the extension arm without a guard 501 and an extension arm with a guard 550 are asymmetrical related to the accessory mounting plate base and therefore the accessory mounting plate. When viewing the extension arm without a guard 501 in a right view as in FIG. 29 and an extension arm with a guard 550 in a front view as in FIG. 38 the accessory mounting base is not centered in the extension arm with different profile on the front side which has a smaller overhang and the rear side which has a larger overhang. The difference in the sides allows for the extension arm structure 500 to be flipped around from the first front and rear definition to allow for the extension arm structure to fit more snuggly up against another object such as a primary accessory on the main accessory rail of the firearm. Sometimes the larger overhang in the rear will fit more snuggly with the primary accessory. Sometimes the larger overhang in the front will fit more snuggly with the primary accessory. The definition of a snug fit and the benefits of a snug fit are described above. In addition to the snug fit, the ability for the extension arm structure 500 to be flipped around from the first front and rear definition to have the larger overhang in the front or the rear of the AOM allows for adjustment of the distance the accessory mounting plate, and therefore the second accessory, is from the user's eye. In FIG. 54 there is a top plan view of the extension arm structure flipped around from the traditional arrangement of the AOM without a guard. This flipped around configuration could be attached to the right side of the main accessory rail. If it were attached to the right side of the main accessory rail then the secondary accessory would be farther from the user. If the flipped around configuration were attached to the left side of the main accessory rail then the secondary accessory would be closer to the user. When the secondary accessory is closer to the user the distance from the user's eye is shortened which can be helpful. The distance of the user's eye from the accessory or optic is called the eye relief. The eye relief has to be the correct distance for the user to easily view the target in the accessory. Therefore adjustment in the distance from the user can be helpful.

Very small adjustments can be made and held in place for the extension arm structure and therefore the secondary accessory with the embodiments of the AOM described. The need to have pre-defined positions is not required. Elements such as notches for determining different angles would not allow for the amount of adjustability allowed from the AOM embodiments described. The contact of the front face of the base piece and the extension arm are flat surfaces. Those flat surfaces allow for a smooth rotation and movement of the extension arm from one position to the next so very fine tuning can be done and then held in place with the tightening of the cinch pivot structure 640.

Another use includes, two AOMs can be attached to the main rail of the firearm. Then a rear iron sight can be attached to the rear AOM and a front iron sight can be attached to the front AOM.

An embodiment of the AOM, such as the clam piece, base piece, extension arm, and accessory mounting plate, can be machined out of aluminum 7075, which has various anodized colors one which can be black anodized.

A flashlight type of accessory can be attached to the AOM. For a flashlight accessory the user may not want the flashlight as close as possible to the primary accessory because of the desired shadow cast by the primary optic and firearm. But the greater adjustability of the AOM embodiments is still beneficial for a secondary accessory, like a flashlight, because the user can place the flashlight where desired, such as based on the shadow cast by the primary optic or firearm.

A Picatinny rail is a standardized type of the rail that is used for mounting accessories to firearms. The Picatinny rail has grooves which run perpendicularly to the longitudinal axis of the rail. When looking at the profile of the perpendicular grooves the grooves have vertical sides. The perpendicular grooves keep a mounted accessory, or mounted mount for other accessories, from moving in a longitudinal direction. When looking at a cross section of the Picatinny rail the rail has a triangular protrusion projecting from each side of the rail at the top. The triangular protrusion allows for a mounted accessory, or a mounted mount for other accessories, to not be pulled off the rail.

If the head of a pivot bolt or other bolt head of a cinch pivot structure is sunk below the surface into a counter sunk hole, the head of the bolt can be considered in contact with the face of the piece the counter sunk hole is in.

The invention claimed is:

1. A mount configured for use with a firearm, comprising, a base structure configured to removably attach to a firearm, the base structure has a rear face and a front face, the base structure has a base hole, the base hole has a first opening and a second opening, the base hole travels through the base structure with the first opening on the rear face of the base structure and the second opening on the front face of the base structure, an extension arm structure, comprising, an extension arm, the extension arm has a rear face and a front face, an extension arm elongated slot hole, the extension arm elongated slot hole has a first opening and a second opening, the extension arm elongated slot hole travels through the extension arm, the first opening of the extension arm elongated slot hole is on the rear face of the extension arm, the second opening of the extension arm elongated slot hole is on the front face of the extension arm, a cross section of the extension arm elongated slot hole, a widest part of the cross section of the extension arm elongated slot hole, a distance of the widest part of the cross section of the extension arm elongated slot hole, the distance of the widest part of the cross section of the extension arm elongated slot hole is 0.3 inches to 0.8 inches, the extension arm has a top face and a bottom face, the extension arm has a distance from the top face to the bottom face, the distance from the top face to the bottom face of the extension arm is 0.55 inches to 1.15 inches, the rear face of the extension arm is in contact with the front face of the base structure, an accessory mounting plate, the accessory mounting plate is attached to the extension arm, a pivot bolt, the pivot bolt has a head, a shaft, and a threaded end section, the head of the pivot bolt connects to the shaft of the pivot bolt, the shaft of the pivot bolt connects to the threaded end section of the pivot bolt, the head of the pivot bolt is in contact with the rear face of the base structure, the shaft of the pivot bolt is oriented through the extension arm elongated slot hole and through the base hole, a washer, a nylon insert lock nut, the threaded end section of the pivot bolt is oriented through the washer, the washer is in contact with the front face of the extension arm, the threaded end section of the pivot bolt is oriented through the nylon insert lock nut, the nylon insert lock nut is in contact with the washer.

2. The mount as in claim 1, the accessory mounting plate is a Picatinny rail.

3. A mount configured for use with a firearm, comprising, a base structure configured to removably attach to a firearm, the base structure has a rear face and a front face, the base structure has a base hole, the base hole has a first opening and a second opening, the base hole travels through the base structure with the first opening on the rear face of the base structure and the second opening on the front face of the base structure, the base structure has a clamp piece, the clamp piece has a left face, a first angled right face, and a second angled right face, a connection between the first angled right face and the second angled right face, the connection between the first angled right face and the second angled right face forms a groove in the clamp piece, the clamp piece has a hole, the hole has a first opening and a second opening, the first opening of the hole is on the left face of the clamp piece, the second opening of the hole is on the first angled right face, the base structure has a base piece, the base piece has a rear, front, right, top, and bottom face, the base piece has a first angled left face, a second angled left face, a third angled left face, and a left face extension overhang, the left face extension overhang protrudes from the base piece, the first angled left face connects to the left face extension overhang, the left face extension overhang has a bottom face, the bottom face of the left face extension overhang had a ridge, the ridge protrudes away from the bottom face of the left face extension overhang, the ridge has a longitudinal axis, a direction of the longitudinal axis of the ridge, the direction of the longitudinal axis of the ridge runs from the first angled left face towards the right face of the base piece, a connection between the first angled left face and the bottom face of the left face extension overhang, the connection between the first angled left face and the bottom face of the left face extension overhang forms a pointed edge, the pointed edge protrudes away from the base piece, the second angled left face connects to the bottom face of the left face extension overhang, a connection between the second angled left face and the third angled left face, the connection between the second angled left face and the third angled left face forms a groove in the base piece, the third angled left face connects to the bottom face of the base piece, a cut away in the first angled left face, a base piece to clamp piece hole, the base piece to clamp piece hole has one opening, the opening is partially through the cut away of the first angled left face and partially through the ridge on the bottom face of the left face extension overhang, the base piece to clamp piece hole is threaded, the rear face of the base piece and the rear face of the clamp piece form the rear face of the base structure, the front face of the base piece and the front face of the clamp piece form the front face of the base structure, the base structure has a clamp piece to base piece screw, the clamp piece to base piece screw has a first end section and a second end section, a head of the clamp piece to base piece screw, the first end section of the clamp piece to base piece screw is the head of the clamp piece to base piece screw, the second end section of the clamp piece to base piece screw is threaded, the clamp piece to base piece screw is oriented through the hole in the clamp piece and the second end section of the clamp piece to base piece screw is oriented in the base piece to clamp piece hole, an extension arm structure, comprising, an extension arm, the extension arm has a rear face and a front face, an extension arm elongated slot hole, the extension arm elongated slot hole has a first opening and a second opening, the extension arm elongated slot hole travels through the extension arm, the first opening of the extension arm elongated slot hole is on the rear face of the extension arm, the second opening of the extension arm elongated slot hole is on the front face of the extension arm, the rear face of the extension arm is in contact with the front face of the base structure, the extension arm has a first end and a second end, an accessory mounting plate base, the accessory mounting plate base connects to the second end of the extension arm, the accessory mounting plate base, is oriented off center of the second end of the extension arm, the accessory mounting plate base has a first accessory mounting plate screw hole, a second accessory mounting plate screw hole, and a mortise hole, the accessory mounting plate base has a top face, the first accessory mounting plate screw hole in oriented on the top face of the accessory mounting plate base, the first accessory mounting plate screw hole has one opening, the opening of the first accessory mounting plate screw hole is on the top face of the accessory mounting plate base, the second accessory mounting plate screw hole is oriented on the top face of the accessory mounting plate base, the second accessory mounting plate screw hole has one opening, the opening of the second accessory mounting plate screw hole is on the top face of the accessory mounting plate base, the mortise hole is oriented on the top face of the accessory mounting plate base, the mortise hole has one opening, the opening of the mortise hole is on the top face of the accessory mounting plate base, an accessory mounting plate, the accessory mounting plate is attached to the accessory mounting plate base, the accessory mounting plate has a top and bottom face, an accessory mounting plate tenon, the accessory mounting plate tenon extends from the bottom face of the accessory mounting plate, the accessory mounting plate has a first accessory mounting plate hole and a second accessory mounting plate hole, the first accessory mounting plate hole has a first opening and a second opening, the first opening of the first accessory mounting plate hole is on the top face of the accessory mounting plate, the second opening of the first accessory mounting plate hole is on the bottom face of the accessory mount plate, the second accessory mounting plate hole has a first opening and a second opening, the first opening of the second accessory mounting plate hole is on the top face of the accessory mounting plate, the second opening of the second accessory mounting plate hole is on the bottom face of the accessory mount plate, a first accessory mounting plate attachment screw, a second accessory mounting plate attachment screw, the first accessory mounting plate attachment screw is oriented through the first accessory mounting plate hole in the accessory mounting plate and into the first accessory mounting plate screw hole in the accessory mounting plate base, the second accessory mounting plate attachment screw is oriented through the second accessory mounting plate hole in the accessory mounting plate and into the second accessory mounting plate screw hole in the accessory mounting plate base, the accessory mounting plate tenon of the accessory mounting plate is oriented in the mortise hole in the accessory mounting plate base, a pivot bolt, the pivot bolt has a head, a shaft, and a threaded end section, the head of the pivot bolt connects to the shaft of the pivot bolt, the shaft of the pivot bolt connects to the threaded end section of the pivot bolt, the head of the pivot bolt is in contact with the rear face of the base structure, the shaft of the pivot bolt is oriented through the extension arm elongated slot hole and through the base hole, a washer, a nylon insert lock nut, the threaded end section of the pivot bolt is oriented through the washer, the washer is in contact with the front face of the extension arm, the threaded end section of the pivot bolt is oriented through the nylon insert lock nut, the nylon insert lock nut is in contact with the washer, a guard of one piece of heavy gauge metal wire, the guard has a first end and a second end, the guard has a central bend, the guard has a first leg and a second leg, the wire on one side of the central bend is the first leg, the wire on the other side of the central bend is the second leg, each of the two legs has at least one bend of 60 degrees to 160 degrees, the accessory mounting plate base has a rear, front, left and right face, the accessory mounting plate base has a first guard hole and a second guard hole, the first guard hole has a first opening and a second opening, the first opening of the first guard hole is on the left face of the accessory mounting plate base, the second opening of the first guard hole is on the right face of the accessory mounting plate base, the second guard hole has a first opening and a second opening, the first opening of the second guard hole is on the left face of the accessory mounting plate base, the second opening of the second guard hole is on the right face of the accessory mounting plate base, the first leg of the guard is oriented inside the first guard hole, the second leg of the guard is oriented inside the second guard hole, a first guard screw, a second guard screw, a first guard screw hole, a second guard screw hole, the first guard screw hole has a first opening and a second opening, the second guard screw hole has a first opening and a second opening, the first guard screw hole travels through the accessory mounting plate base with the first opening of the first guard screw hole oriented inside the first guard hole and the second opening of the first guard screw hole oriented on the front face of the accessory mounting plate base, the second guard screw hole travels through the accessory mounting plate base with the first opening of the second guard screw hole oriented inside the second guard hole and the second opening of the second guard screw hole oriented on the rear face of the accessory mounting plate base, the first guard screw is oriented in the first guard screw hole, the second guard screw is oriented in the second guard screw hole.

4. The mount as in claim 3, the accessory mounting plate is a Picatinny rail.

5. The mount as in claim 4, a cross section of the extension arm elongated slot hole, a widest part of the cross section of the extension arm elongated slot hole, a distance of the widest part of the cross section of the extension arm elongated slot hole, the distance of the widest part of the cross section of the extension arm elongated slot hole is 0.3 inches to 0.8 inches, the extension arm has a bottom face, a distance from the bottom face of the extension arm to the top face of the accessory mounting plate base, the distance from the bottom face of the extension arm to the top face of the accessory mounting plate base is 0.55 inches to 1.15 inches.

6. The mount as in claim 5, the base piece, the clamp piece, the extension arm, the accessory mounting plate base, and the accessory mounting plate are made of aluminum.

* * * * *